US010636432B2

(12) United States Patent
Liu et al.

(10) Patent No.: US 10,636,432 B2
(45) **Date of Patent: *Apr. 28, 2020**

(54) METHOD FOR PREDICTING HIGH FREQUENCY BAND SIGNAL, ENCODING DEVICE, AND DECODING DEVICE

(71) Applicant: Huawei Technologies Co., Ltd., Shenzhen (CN)

(72) Inventors: Zexin Liu, Beijing (CN); Lei Miao, Beijing (CN); Fengyan Qi, Shenzhen (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/106,700

(22) Filed: Aug. 21, 2018

(65) Prior Publication Data

US 2018/0366134 A1 Dec. 20, 2018

Related U.S. Application Data

(63) Continuation of application No. 15/615,810, filed on Jun. 6, 2017, now Pat. No. 10,089,997, which is a (Continued)

(30) Foreign Application Priority Data

Jan. 29, 2013 (CN) ..... 2013 1 0033625

(51) Int. Cl.
*G10L 19/20* (2013.01)
*G10L 19/04* (2013.01)
(Continued)

(52) U.S. Cl.
CPC ..... *G10L 19/20* (2013.01); *G10L 19/04* (2013.01); *G10L 21/02* (2013.01); *G10L 21/038* (2013.01)

(58) Field of Classification Search
CPC ..... G10L 19/20
(Continued)

(56) References Cited

U.S. PATENT DOCUMENTS 8,468,025 B2 6/2013 Liu et al.
8,600,765 B2 12/2013 Liu et al.
(Continued)

FOREIGN PATENT DOCUMENTS

BR PI0607690 A2 9/2009
CN 101083076 A 12/2007
(Continued)

OTHER PUBLICATIONS

Machine Translation and Abstract of Chinese Publication No. CN101184979, May 21, 2008, 79 pages.
(Continued)

*Primary Examiner* — Susan I McFadden
(74) *Attorney, Agent, or Firm* — Conley Rose, P.C.

(57) ABSTRACT

An audio signal decoding method includes obtaining mode information of a high frequency band signal of an audio signal and indices of a low frequency band signal of the audio signal by parsing a received bitstream, obtaining the low frequency band signal based on the indices, predicting an excitation signal of a high frequency band signal based on the low frequency band signal, and reconstructing the high frequency band signal based on the frequency envelope and the excitation signal. A manner for obtaining the frequency envelope of the high frequency band signal when mode information indicates the high frequency band signal is a harmonic type signal is different from a manner for obtaining the frequency envelope of the high frequency band signal when the mode information indicates the high frequency band signal is a non-harmonic type signal.

20 Claims, 8 Drawing Sheets

Related U.S. Application Data continuation of application No. 14/808,145, filed on Jul. 24, 2015, now Pat. No. 9,704,500, which is a continuation of application No. PCT/CN2013/076408, filed on May 29, 2013.

(51) Int. Cl.
*G10L 21/02* (2013.01)
*G10L 21/038* (2013.01)

(58) Field of Classification Search
USPC ..... 704/205
See application file for complete search history.

(56) References Cited

U.S. PATENT DOCUMENTS

| | | | |
|---|---|---|---|
| 8,825,496 | B2 | 9/2014 | Setiawan et al. |
| 9,161,038 | B2 | 10/2015 | Liu et al. |
| 9,361,904 | B2 | 6/2016 | Liu et al. |
| 9,489,959 | B2 | 11/2016 | Nagisetty et al. |
| 9,548,060 | B1 | 1/2017 | Truman et al. |
| 9,704,500 | B2 | 7/2017 | Liu et al. |
| 10,089,997 | B2 * | 10/2018 | Liu ..... G10L 19/20 |
| 2004/0243402 | A1 | 12/2004 | Ozawa |
| 2007/0282599 | A1 | 12/2007 | Choo et al. |
| 2007/0288232 | A1 | 12/2007 | Kim |
| 2008/0109215 | A1 | 5/2008 | Liu et al. |
| 2010/0094638 | A1 | 4/2010 | Lee et al. |
| 2011/0194598 | A1 | 8/2011 | Mia et al. |
| 2011/0238427 | A1 | 9/2011 | Chen et al. |
| 2012/0065965 | A1 | 3/2012 | Choo et al. |
| 2012/0209597 | A1 | 8/2012 | Yamanashi |
| 2013/0090934 | A1 | 4/2013 | Nagel et al. |
| 2013/0117029 | A1 | 5/2013 | Liu et al. |
| 2017/0309295 | A1 | 10/2017 | Villemoes |

FOREIGN PATENT DOCUMENTS

| | | | |
|---|---|---|---|
| CN | 101140759 | A | 3/2008 |
| CN | 101184979 | A | 5/2008 |
| CN | 101521014 | A | 9/2009 |
| CN | 101763856 | A | 6/2010 |
| CN | 101964189 | A | 2/2011 |
| CN | 102027537 | A | 4/2011 |
| CN | 102044250 | A | 5/2011 |
| CN | 102598123 | A | 7/2012 |
| CN | 102741921 | A | 10/2012 |
| CN | 102800317 | A | 11/2012 |
| EP | 2224432 | A1 | 9/2010 |
| EP | 2239732 | A1 | 10/2010 |
| EP | 1864101 | B1 | 8/2012 |
| EP | 2485029 | A1 | 8/2012 |
| JP | 2002372993 | A | 12/2002 |
| JP | 2010538318 | A | 12/2010 |
| JP | 2012511731 | A | 5/2012 |
| WO | 2009029037 | A1 | 3/2009 |
| WO | 2009078681 | A1 | 6/2009 |
| WO | 2009081568 | A1 | 7/2009 |
| WO | 2009095169 | A1 | 8/2009 |
| WO | 2010091013 | A1 | 8/2010 |

OTHER PUBLICATIONS

Foreign Communication From a Counterpart Application, Chinese Application No. 201710076995.3, Chinese Office Action dated Jul. 19, 2019, 2 pages.
Foreign Communication From a Counterpart Application, Chinese Application No. 201710076995.3, Chinese Search Report dated Jul. 19, 2019, 1 page.
Machine Translation and Abstract of Chinese Publication No. CN101140759, Mar. 12, 2008, 34 pages.
Machine Translation and Abstract of Chinese Publication No. CN101521014, Sep. 2, 2009, 17 pages.
Machine Translation and Abstract of Chinese Publication No. CN102044250, May 4, 2011, 22 pages.
Machine Translation and Abstract of Japanese Publication No. JP2002372993, Dec. 26, 2002, 20 pages.
"Series G: Transmission Systems and Media,Digital Systems and Networks, Digital terminal equipments—Coding of voice and audiosignals, 7 kHz audio-coding within 64 kbit/s, Amendment 1: New Annex B with superwideband embedded extension," ITU-T G.722, Amendment 1, Nov. 2010, 96 pages.
"Information technology—MPEG audio technologies—Part 3: Unified speech and audio coding," ISO/IEC FDIS 23003-3:2011, ISO/IEC JTC 1/SC 29/WG 11, Sep. 20, 2011, 291 pages.
Neuendorf, M., et al, "MPEG Unified Speech and Audio Coding—The ISO/MPEG Standard for High-Efficiency Audio Coding of all Content Types," Audio Engineering Society Convention Paper, Presented at the 132nd Convention, Apr. 26-29, 2012, Budapest, Hungary, 22 pages.
Kornagel, U., "Techniques for artificial bandwidth extension of telephone speech," Signal Processing, vol. 86, No. 6, Jun. 1, 2006, pp. 1296-1306.
"Series G: Transmission Systems and Media, Digital Systems and Networks, Digital terminal equipments—Coding of voice and audiosignals, Wideband embedded extension for G.711 pulsecode modulation, Amendment 5: New Appendix IV extending Annex D superwideband for mid-side stereo," ITU-T G711.1, Amendment 5, Mar. 2011, 12 pages.
Foreign Communication From a Counterpart Application, European Application No. 13873224.3, Partial Supplementary European Search Report dated Feb. 19, 2016, 8 pages.
Foreign Communication From a Counterpart Application, Korean Application No. 1020187006404, Korean Notice of Preliminary Rejection dated May 14, 2018, 7 pages.
Foreign Communication From a Counterpart Application, Korean Application No. 1020187006404, Korean Report Letter on Preliminary Rejection dated May 28, 2018, 8 pages.
Foreign Communication From a Counterpart Application, Chinese Application No. 201310033625.3, Chinese Office Action dated Jun. 3, 2016, 13 pages.
Foreign Communication From a Counterpart Application, European Application No. 13873224.3, Extended European Search Report dated Jul. 4, 2016, 13 pages.
Foreign Communication From a Counterpart Application, Korean Application No. 1020157022814, Korean Notice of Preliminary Rejection dated Jul. 28, 2016, 8 pages.
Foreign Communication From a Counterpart Application, Korean Application No. 1020157022814, Korean Report Letter on Office Action dated Aug. 11, 2016, 8 pages.
Foreign Communication From a Counterpart Application, Japanese Application No. 2015-555543, Japanese Office Action dated Nov. 8, 2016, 4 pages.
Foreign Communication From a Counterpart Application, Japanese Application No. 2015-555543, English Translation of Japanese Office Action dated Nov. 8, 2016, 4 pages.
Foreign Communication From a Counterpart Application, Chinese Application No. 2013100336253, Chinese Search Report dated Nov. 23, 2016, 2 pages.
Foreign Communication From a Counterpart Application, Chinese Application No. 201310033625.3, Chinese Issue Notification dated Dec. 2, 2016, 1 page.
Foreign Communication From a Counterpart Application, Chinese Application No. 201310033625.3, Chinese Notice of Allowance dated Dec. 2, 2016, 1 page.
Foreign Communication From a Counterpart Application, PCT Application No. PCT/CN2013/076408, English Translation of International Search Report dated Nov. 7, 2013, 3 pages.
Foreign Communication From a Counterpart Application, PCT Application No. PCT/CN2013/076408, English Translation of Written Opinion dated Nov. 7, 2013, 12 pages.
Foreign Communication From a Counterpart Application, Japanese Application No. 2017-165309, Japanese Office Action dated Nov. 19, 2018, 3 pages.

(56) References Cited

OTHER PUBLICATIONS

Foreign Communication From a Counterpart Application, Japanese Application No. 2017-165309, English Translation of Japanese Office Action dated Nov. 19, 2018, 4 pages.
Dietz, M., et al. "Spectral Band Replication, a novel approach in audio coding," Audio Engineering Society, Convention Paper 5553, May 10-13, 2002, 8 pages.
Foreign Communication From a Counterpart Application, Brazilian Application No. 112015018064-7, Brazilian Office Action dated Jun. 16, 2019, 9 pages.
Foreign Communication From a Counterpart Application, Brazilian Application No. 112015018064-7, English Translation of Brazilian Office Action dated Aug. 6, 2019, 4 pages.

* cited by examiner

METHOD FOR PREDICTING HIGH FREQUENCY BAND SIGNAL, ENCODING DEVICE, AND DECODING DEVICE

CROSS-REFERENCE TO RELATED APPLICATIONS

This application is a continuation of U.S. patent application Ser. No. 15/615,810 filed on Jun. 6, 2017. The U.S. patent application Ser. No. 15/615,810 is a continuation of U.S. patent application Ser. No. 14/808,145 filed on Jul. 24, 2015, now U.S. Pat. No. 9,704,500. The U.S. patent application Ser. No. 14/808,145 is a continuation of International Patent Application No. PCT/CN2013/076408 filed on May 29, 2013. The International Patent Application claims priority to Chinese Patent Application No. 201310033625.3 filed on Jan. 29, 2013. All of the afore-mentioned patent applications are hereby incorporated by reference in their entireties.

TECHNICAL FIELD

Embodiments of the present disclosure relate to the field of communications technologies, and in particular, to a method for predicting a high frequency band signal, an encoding device, and a decoding device.

BACKGROUND

In the field of digital communications, there are extremely widespread application requirements for voice, picture, audio, and video transmission, such as a phone call, an audio and video conference, broadcast television, and multimedia entertainment. To reduce a resource occupied in a process of storing or transmitting an audio or video signal, an audio and video compression and encoding technology comes into existence. Many different technical branches emerge in the development of the audio and video compression and encoding technology, where a technology in which a signal is encoding processed after being transformed from a time domain to a frequency domain is widely applied due to a good compression characteristic, and the technology is also referred to as a domain transformation encoding technology.

An increasing emphasis is placed on audio quality in communication transmission, therefore, there is a need to improve quality of a music signal as much as possible on a premise that voice quality is ensured. Meanwhile, the amount of information of an audio signal is extremely rich. Therefore, a code excited linear prediction (CELP) encoding mode of conventional voice cannot be adopted, instead, generally, to process the audio signal, a time domain signal is transformed into a frequency domain signal using an audio encoding technology of domain transformation encoding, thereby enhancing encoding quality of the audio signal.

In an existing audio encoding technology, generally, by adopting a transformation technology, such as fast Fourier transform (FFT) or modified discrete cosine transform (MDCT) or discrete cosine transform (DCT), a high frequency band signal in an audio signal is transformed from a time domain signal to a frequency domain signal, and then, the frequency domain signal is encoded.

In the case of a low bit rate, limited quantization bits cannot quantize all to-be-quantized audio signals. Therefore, an encoding device uses most bits to elaborately quantize relatively important low frequency band signals in the audio signals, that is, quantization parameters of the low frequency band signals occupy most bits, and only a few bits are used to roughly quantize and encode high frequency band signals in the audio signals to obtain frequency envelopes of the high frequency band signals. Then, the frequency envelopes of the high frequency band signals and the quantization parameters of the low frequency band signals are sent to a decoding device in a form of a bitstream. The quantization parameters of the low frequency band signals may include excitation signals and frequency envelopes. When being quantized, the low frequency band signals may first also be transformed from time domain signals to frequency domain signals, and then, the frequency domain signals are quantized and encoded into excitation signals.

Generally, the decoding device may restore the low frequency band signals according to the quantization parameters that are of the low frequency band signals and in the received bitstream, then acquire the excitation signals of the low frequency band signals according to the low frequency band signals, predict excitation signals of the high frequency band signals using a bandwidth extension (also referred to as BWE) technology and a spectrum filling technology and according to the excitation signals of the low frequency band signals, and modify the predicted excitation signals of the high frequency band signals according to the frequency envelopes that are of the high frequency band signals and in the bitstream, to obtain predicted high frequency band signals. Herein, the obtained high frequency band signals are frequency domain signals.

In the BWE technology, a highest frequency bin to which a bit is allocated may be a highest frequency bin to which an excitation signal is decoded, that is, no excitation signal is decoded on a frequency bin greater than the highest frequency bin. A frequency band greater than the highest frequency bin to which a bit is allocated may be referred to as a high frequency band, and a frequency band less than the highest frequency bin to which a bit is allocated may be referred to as a low frequency band. That an excitation signal of a high frequency band signal is predicted according to an excitation signal of a low frequency band signal may be as follows. The highest frequency bin to which a bit is allocated is considered as a center, an excitation signal of a low frequency band signal less than the highest frequency bin to which a bit is allocated is copied into a high frequency band signal that is greater than the highest frequency bin to which a bit is allocated and whose bandwidth is equal to bandwidth of the low frequency band signal, and the excitation signal is used as an excitation signal of the high frequency band signal.

The other approaches has the following disadvantages. Using the foregoing other approaches to predict a high frequency band signal, quality of the predicted high frequency band signal is relatively poor, thereby reducing auditory quality of an audio signal.

SUMMARY

Embodiments of the present disclosure provide a method for predicting a high frequency band signal, an encoding device, and a decoding device in order to improve quality of a predicted high frequency band signal, thereby enhancing auditory quality of an audio signal.

According to a first aspect, an embodiment of the present disclosure provides a method for predicting a high frequency band signal, including acquiring a signal type of a to-be-decoded audio signal and a low frequency band signal of the audio signal, acquiring a frequency envelope of a high frequency band signal of the audio signal according to the signal type, predicting an excitation signal of the high frequency band signal of the audio signal according to the low frequency band signal of the audio signal, and restoring the high frequency band signal of the audio signal according to the frequency envelope of the high frequency band signal and the excitation signal of the high frequency band signal.

With reference to the first aspect, in a first implementation manner of the first aspect, the signal type is a harmonic signal or a non-harmonic signal, and acquiring a frequency envelope of a high frequency band signal of the audio signal according to the signal type includes decoding a received bitstream of the audio signal to obtain the frequency envelope of the high frequency band signal of the audio signal when the signal type is a non-harmonic signal, or decoding a received bitstream of the audio signal to obtain an initial frequency envelope of the high frequency band signal of the audio signal when the signal type is a harmonic signal, and using a value obtained by performing weighting calculation on the initial frequency envelope and N adjacent initial frequency envelopes as the frequency envelope of the high frequency band signal, where N is greater than or equal to 1.

With reference to the first aspect, in a second implementation manner of the first aspect, the signal type is a harmonic signal or a non-harmonic signal, and acquiring a frequency envelope of a high frequency band signal of the audio signal according to the signal type includes decoding a received bitstream of the audio signal according to the signal type to acquire the corresponding frequency envelope of the high frequency band signal, where the bitstream of the audio signal carries the signal type and an encoding index of the frequency envelope of the high frequency band signal.

With reference to the first aspect and the foregoing implementation manners of the first aspect, in a third implementation manner of the first aspect, acquiring a signal type of a to-be decoded audio signal and a low frequency band signal of the audio signal includes decoding the received bitstream of the audio signal to obtain the signal type and the low frequency band signal, where the signal type is a harmonic signal or a non-harmonic signal.

With reference to the first aspect and the foregoing implementation manners of the first aspect, in a fourth implementation manner of the first aspect, acquiring a signal type of a to-be-decoded audio signal and a low frequency band signal of the audio signal includes decoding the received bitstream of the audio signal to obtain the low frequency band signal of the audio signal, and determining the signal type according to the low frequency band signal, where the signal type is a harmonic signal or a non-harmonic signal.

With reference to the first aspect and the foregoing implementation manners of the first aspect, in a fifth implementation manner of the first aspect, predicting an excitation signal of the high frequency band signal of the audio signal according to the low frequency band signal of the audio signal includes determining a highest frequency bin, to which a bit is allocated, of the low frequency band signal, determining whether the highest frequency bin, to which a bit is allocated, of the low frequency band signal is less than a preset start frequency bin of bandwidth extension of the high frequency band signal, and when the highest frequency bin, to which a bit is allocated, of the low frequency band signal is less than the preset start frequency bin of the bandwidth extension of the high frequency band signal, predicting the excitation signal of the high frequency band signal according to an excitation signal that falls within a predetermined frequency band range and in the low frequency band signal and the preset start frequency bin of the bandwidth extension of the high frequency band signal, or when the highest frequency bin, to which a bit is allocated, of the low frequency band signal is greater than or equal to the preset start frequency bin of the bandwidth extension of the high frequency band signal, predicting the excitation signal of the high frequency band signal according to an excitation signal that falls within a predetermined frequency band range and in the low frequency band signal, the preset start frequency bin of the bandwidth extension of the high frequency band signal, and the highest frequency bin, to which a bit is allocated, of the low frequency band signal.

With reference to the first aspect and the foregoing implementation manners of the first aspect, in a sixth implementation manner of the first aspect, predicting the excitation signal of the high frequency band signal according to an excitation signal that falls within a predetermined frequency band range and in the low frequency band signal and the preset start frequency bin of the bandwidth extension of the high frequency band signal includes making n copies of the excitation signal within the predetermined frequency band range, and using the n copies of the excitation signal as an excitation signal between the preset start frequency bin of the bandwidth extension of the high frequency band signal and a highest frequency bin of the bandwidth extension frequency band, where n is a positive integer or a positive decimal, and n is equal to a ratio of a quantity of frequency bins between the preset start frequency bin of the bandwidth extension of the high frequency band signal and the highest frequency bin of the bandwidth extension frequency band to a quantity of frequency bins within the predetermined frequency band range.

With reference to the first aspect and the foregoing implementation manners of the first aspect, in a seventh implementation manner of the first aspect, predicting the excitation signal of the high frequency band signal according to an excitation signal that falls within a predetermined frequency band range and in the low frequency band signal, the preset start frequency bin of the bandwidth extension of the high frequency band signal, and the highest frequency bin, to which a bit is allocated, of the low frequency band signal includes copying an excitation signal from the $m^{th}$ frequency bin above a start frequency bin $f_{exc_start}$ of the predetermined frequency band range to an end frequency bin $f_{exc_end}$ of the predetermined frequency band range and making n copies of the excitation signal within the predetermined frequency band range, and using the two parts of excitation signals as an excitation signal between the highest frequency bin, to which a bit is allocated, of the low frequency band signal and a highest frequency bin of the bandwidth extension frequency band, where n is 0, a positive integer, or a positive decimal, and m is a quantity of frequency bins between the highest frequency bin, to which a bit is allocated, of the low frequency band signal and the preset start frequency bin of the extension frequency band.

According to a second aspect, an embodiment of the present disclosure further provides a method for predicting a high frequency band signal, including acquiring a signal type of an audio signal and a low frequency band signal of the audio signal, encoding a frequency envelope of a high frequency band signal of the audio signal according to the signal type to obtain the frequency envelope of the high frequency band signal, sending, to a decoding device, a bitstream that carries the signal type, and encoding indices of the low frequency band signal and the frequency envelope of the high frequency band signal.

With reference to the second aspect, in an implementation manner of the second aspect, the signal type is a harmonic signal or a non-harmonic signal, and encoding a frequency envelope of a high frequency band signal of the audio signal according to the signal type to obtain the frequency envelope of the high frequency band signal includes calculating the frequency envelope of the high frequency band signal using a first quantity of spectrum coefficients when the signal type is a non-harmonic signal, and calculating the frequency envelope of the high frequency band signal using a second quantity of spectrum coefficients when the signal type is a harmonic signal, where the second quantity is greater than the first quantity.

According to a third aspect, an embodiment of the present disclosure further provides a method for predicting a high frequency band signal, including acquiring a signal type of an audio signal and a low frequency band signal of the audio signal, where the signal type is a harmonic signal or a non-harmonic signal, and the audio signal includes the low frequency band signal and a high frequency band signal, calculating a frequency envelope of the high frequency band signal of the audio signal, where a same quantity of spectrum coefficients are used to calculate frequency envelopes of high frequency band signals of a harmonic signal and a non-harmonic signal, and sending, to a decoding device, a bitstream that carries the signal type, and encoding indices of the low frequency band signal and the frequency envelope of the high frequency band signal.

According to a fourth aspect, an embodiment of the present disclosure further provides a decoding device, including a first acquiring module configured to acquire a signal type of a to-be-decoded audio signal and a low frequency band signal of the audio signal, a second acquiring module configured to acquire a frequency envelope of a high frequency band signal of the audio signal according to the signal type, a predicting module configured to predict an excitation signal of the high frequency band signal of the audio signal according to the low frequency band signal of the audio signal, and a restoring module configured to restore the high frequency band signal of the audio signal according to the frequency envelope of the high frequency band signal and the excitation signal of the high frequency band signal.

With reference to the fourth aspect, in a first implementation manner of the fourth aspect, the signal type is a harmonic signal or a non-harmonic signal, and the second acquiring module is further configured to decode a received bitstream of the audio signal to obtain the frequency envelope of the high frequency band signal when the signal type is a non-harmonic signal, or the second acquiring module is further configured to decode a received bitstream of the audio signal to obtain an initial frequency envelope of the high frequency band signal when the signal type is a harmonic signal, and use a value obtained by performing weighting calculation on the initial frequency envelope and N adjacent initial frequency envelopes as the frequency envelope of the high frequency band signal, where N is greater than or equal to 1.

With reference to the fourth aspect, in a second implementation manner of the fourth aspect, the signal type is a harmonic signal or a non-harmonic signal, the second acquiring module is further configured to decode a received bitstream of the audio signal according to the signal type to acquire the corresponding frequency envelope of the high frequency band signal, and the bitstream of the audio signal carries the signal type and an encoding index of the frequency envelope of the high frequency band signal.

With reference to the fourth aspect and the foregoing implementation manners of the fourth aspect, in a third implementation manner of the fourth aspect, the first acquiring module is further configured to decode the received bitstream of the audio signal to obtain the signal type and the low frequency band signal, and the signal type is a harmonic signal or a non-harmonic signal.

With reference to the fourth aspect and the foregoing implementation manners of the fourth aspect, in a fourth implementation manner of the fourth aspect, the first acquiring module is further configured to decode the received bitstream of the audio signal to obtain the low frequency band signal of the audio signal, and determine the signal type according to the low frequency band signal, and the signal type is a harmonic signal or a non-harmonic signal.

With reference to the fourth aspect and the foregoing implementation manners of the fourth aspect, in a fifth implementation manner of the fourth aspect, the predicting module includes a determining unit configured to determine a highest frequency bin, to which a bit is allocated, of the low frequency band signal, a judging unit configured to determine whether the highest frequency bin, to which a bit is allocated, of the low frequency band signal is less than a preset start frequency bin of bandwidth extension of the high frequency band signal, and when the judging unit determines that the highest frequency bin, to which a bit is allocated, of the low frequency band signal is less than the preset start frequency bin of the bandwidth extension of the high frequency band signal, a first processing unit configured to predict the excitation signal of the high frequency band signal according to an excitation signal that falls within a predetermined frequency band range and in the low frequency band signal and the preset start frequency bin of the bandwidth extension of the high frequency band signal, or when the judging unit determines that the highest frequency bin, to which a bit is allocated, of the low frequency band signal is greater than or equal to the preset start frequency bin of the bandwidth extension of the high frequency band signal, a second processing unit configured to predict the excitation signal of the high frequency band signal according to an excitation signal that falls within a predetermined frequency band range and in the low frequency band signal, the preset start frequency bin of the bandwidth extension of the high frequency band signal, and the highest frequency bin, to which a bit is allocated, of the low frequency band signal.

With reference to the fourth aspect and the foregoing implementation manners of the fourth aspect, in a sixth implementation manner of the fourth aspect, when the judging unit determines that the highest frequency bin, to which a bit is allocated, of the low frequency band signal is less than the preset start frequency bin of the bandwidth extension of the high frequency band signal, the first processing unit is further configured to make n copies of the excitation signal within the predetermined frequency band range, and use the n copies of the excitation signal as an excitation signal between the preset start frequency bin of the bandwidth extension of the high frequency band signal and a highest frequency bin of the bandwidth extension frequency band, where n is a positive integer or a positive decimal, and n is equal to a ratio of a quantity of frequency bins between the preset start frequency bin of the bandwidth extension of the high frequency band signal and the highest frequency bin of the bandwidth extension frequency band to a quantity of frequency bins within the predetermined frequency band range.

With reference to the fourth aspect and the foregoing implementation manners of the fourth aspect, in a seventh implementation manner of the fourth aspect, when the judging unit determines that the highest frequency bin, to which a bit is allocated, of the low frequency band signal is greater than or equal to the preset start frequency bin of the bandwidth extension of the high frequency band signal, the second processing unit is further configured to copy an excitation signal from the $m^{th}$ frequency bin above a start frequency bin $f_{exc_start}$ of the predetermined frequency band range to an end frequency bin $f_{exc_end}$ of the predetermined frequency band range and make n copies of the excitation signal within the predetermined frequency band range, and use the two parts of excitation signals as an excitation signal between the highest frequency bin, to which a bit is allocated, of the low frequency band signal and a highest frequency bin of the bandwidth extension frequency band, where n is 0, a positive integer, or a positive decimal, and m is a quantity of frequency bins between the highest frequency bin, to which a bit is allocated, of the low frequency band signal and the preset start frequency bin of the extension frequency band.

According to a fifth aspect, an embodiment of the present disclosure further provides an encoding device, including an acquiring module configured to acquire a signal type of an audio signal and a low frequency band signal of the audio signal, an encoding module configured to encode a frequency envelope of a high frequency band signal of the audio signal according to the signal type to obtain the frequency envelope of the high frequency band signal, and a sending module configured to send, to a decoding device, a bitstream that carries the signal type, and encoding indices of the low frequency band signal and the frequency envelope of the high frequency band signal.

With reference to the fifth aspect, in an implementation manner of the fifth aspect, the signal type is a harmonic signal or a non-harmonic signal, and the encoding module is further configured to calculate the frequency envelope of the high frequency band signal using a first quantity of spectrum coefficients when the signal type is a non-harmonic signal, or the encoding module is further configured to calculate the frequency envelope of the high frequency band signal using a second quantity of spectrum coefficients when the signal type is a harmonic signal, where the second quantity is greater than the first quantity.

According to a sixth aspect, an embodiment of the present disclosure further provides an encoding device, including an acquiring module configured to acquire a signal type of an audio signal and a low frequency band signal of the audio signal, where the signal type is a harmonic signal or a non-harmonic signal, and the audio signal includes the low frequency band signal and a high frequency band signal, a calculating module configured to calculate a frequency envelope of the high frequency band signal of the audio signal, where a same quantity of spectrum coefficients are used to calculate frequency envelopes of high frequency band signals of a harmonic signal and a non-harmonic signal, and a sending module configured to send, to a decoding device, a bitstream that carries the signal type, and encoding indices of the low frequency band signal and the frequency envelope of the high frequency band signal. According to the method and a system for predicting a high frequency band signal, the encoding device, and the decoding device in the embodiments of the present disclosure, for a signal of a different type, a different spectrum coefficient is used to decode an envelope such that excitation signal of a high frequency band harmonic signal predicted according to a low frequency band signal can maintain an original harmonic characteristic, thereby improving quality of a predicted high frequency band signal and enhancing auditory quality of an audio signal.

BRIEF DESCRIPTION OF DRAWINGS

To describe the technical solutions in the embodiments of the present disclosure more clearly, the following briefly introduces the accompanying drawings required for describing the embodiments. The accompanying drawings in the following description show some embodiments of the present disclosure, and a person of ordinary skill in the art may still derive other drawings from these accompanying drawings without creative efforts.

DESCRIPTION OF EMBODIMENTS

To make the objectives, technical solutions, and advantages of the embodiments of the present disclosure clearer, the following clearly and completely describes the technical solutions in the embodiments of the present disclosure with reference to the accompanying drawings in the embodiments of the present disclosure. The described embodiments are some but not all of the embodiments of the present disclosure. All other embodiments obtained by a person of ordinary skill in the art based on the embodiments of the present disclosure without creative efforts shall fall within the protection scope of the present disclosure.

In the field of digital signal processing, audio codecs and video codecs are widely applied to various electronic devices, for example, a mobile phone, a wireless apparatus, a personal data assistant (PDA), a handheld or portable computer, a global positioning system (GPS) receiver/navigator, a camera, an audio/video player, a camcorder, a video recorder, and a monitoring device. Generally, this type of electronic device includes an audio encoder or an audio decoder, where the audio encoder or decoder may be directly implemented by a digital circuit or a chip, for example, a digital signal processor (DSP), or be implemented by software code driving a processor to execute a process in the software code.

For example, an audio encoder first performs framing processing on an input signal to obtain time domain data with one frame being 20 milliseconds (ms), then performs windowing processing on the time domain data to obtain a signal after windowing, performs frequency domain transformation on the time domain signal after windowing to transform the time domain signal into a frequency domain signal, encodes the frequency domain signal, and transmits the encoded frequency domain signal to a decoder side. After receiving a compressed bitstream transmitted by an encoder side, the decoder side performs a corresponding decoding operation on the signal, performs, on a frequency domain signal obtained by decoding, inverse transformation corresponding to transformation used by the encoder side, to transform the frequency domain signal into a time domain signal, and performs post processing on the time domain signal to obtain a synthesized signal, that is, a signal output by the decoder side.

Figure 1:
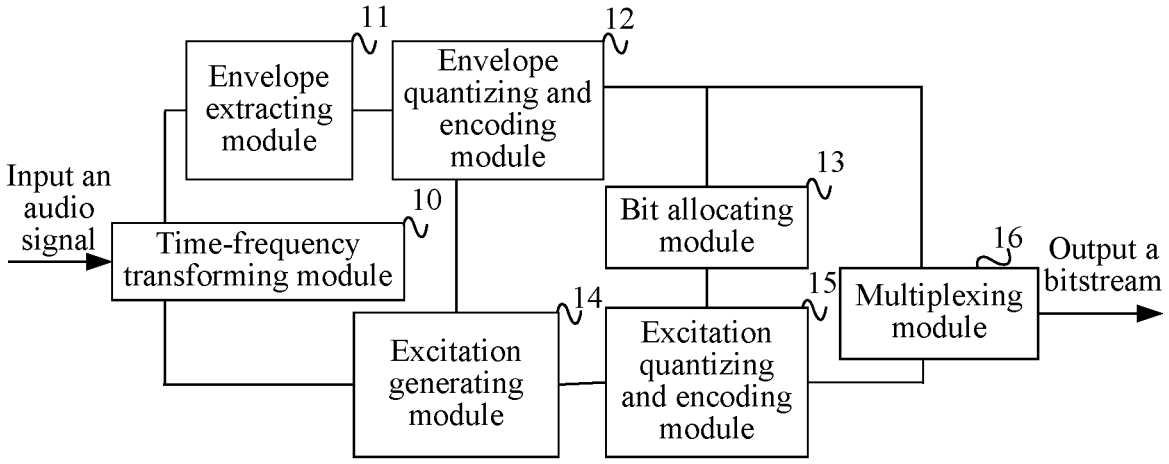
FIG. 1 is a schematic structural diagram of an encoding device.

FIG. 1 is a schematic structural diagram of an encoding. As shown in FIG. 1, the encoding device includes a time-frequency transforming module 10, an envelope extracting module 11, an envelope quantizing and encoding module 12, a bit allocating module 13, an excitation generating module 14, an excitation quantizing and encoding module 15, and a multiplexing module 16.

As shown in FIG. 1, the time-frequency transforming module 10 is configured to receive an input audio signal, and then transform the audio signal from a time domain signal to a frequency domain signal. Then, the envelope extracting module 11 extracts a frequency envelope from the frequency domain signal obtained by transformation by the time-frequency transforming module 10, where the frequency envelope may also be referred to as a subband normalization factor. Herein, the frequency envelope includes a frequency envelope of a low frequency band signal and a frequency envelope of a high frequency band signal, where the low frequency band signal and the high frequency band signal are in the frequency domain signal. The envelope quantizing and encoding module 12 performs quantizing and encoding processing on the frequency envelope obtained by the envelope extracting module 11, to obtain a quantized and encoded frequency envelope. The bit allocating module 13 determines a bit allocation of each subband according to the quantized frequency envelope. The excitation generating module 14 performs, using envelope information obtained after quantizing and encoding by the envelope quantizing and encoding module 12, normalization processing on the frequency domain signal obtained by the time-frequency transforming module 10, to obtain an excitation signal, that is, a normalized frequency domain signal, and the excitation signal also includes an excitation signal of the high frequency band signal and an excitation signal of the low frequency band signal. The excitation quantizing and encoding module 15 performs, according to the bit allocation of each subband allocated by the bit allocating module 13, quantizing and encoding processing on the excitation signal generated by the excitation generating module 14, to obtain a quantized excitation signal. The multiplexing module 16 separately multiplexes the frequency envelope quantized by the envelope quantizing and encoding module 12 and the excitation signal quantized by the excitation quantizing and encoding module 15 into a bitstream, and outputs the bitstream to a decoding device.

Figure 2:
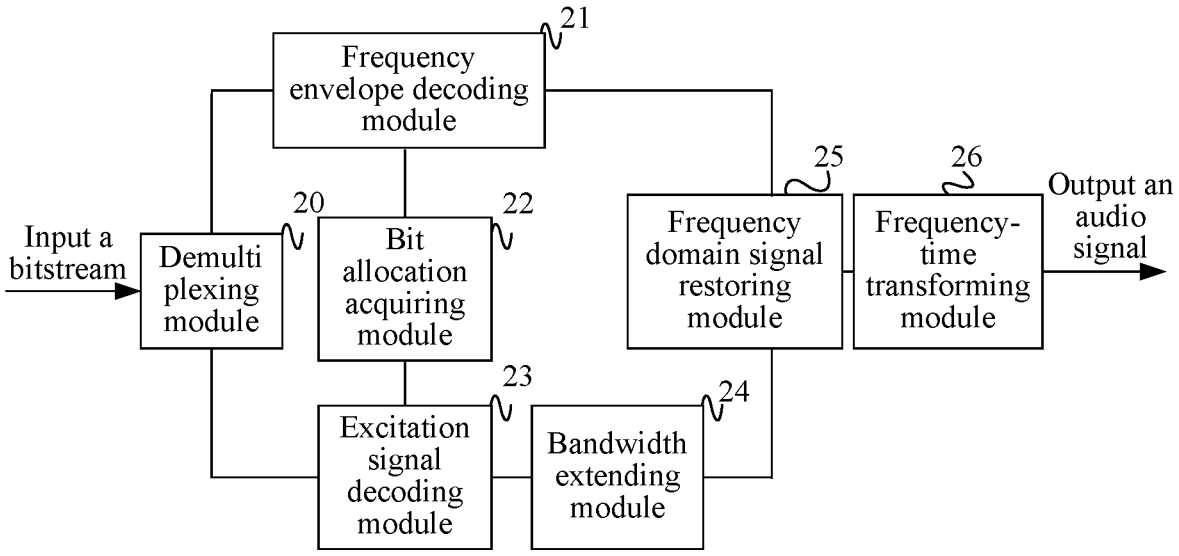
FIG. 2 is a schematic structural diagram of a decoding device.

FIG. 2 is a schematic structural diagram of a decoding device. As shown in FIG. 2, the decoding device includes a demultiplexing module 20, a frequency envelope decoding module 21, a bit allocation acquiring module 22, an excitation signal decoding module 23, a bandwidth extension module 24, a frequency domain signal restoring module 25, and a frequency-time transforming module 26.

As shown in FIG. 2, the demultiplexing module 20 receives a bitstream sent from a side of an encoding device, and demultiplexes (including decoding) the bitstream to separately obtain a quantized frequency envelope and a quantized excitation signal. The frequency envelope decoding module 21 acquires the quantized frequency envelope from a signal obtained by demultiplexing by the demultiplexing module 20, and quantizes and decodes the quantized frequency envelope to obtain a frequency envelope. The bit allocation acquiring module 22 determines a bit allocation of each subband according to the frequency envelope obtained by the frequency envelope decoding module 21. The excitation signal decoding module 23 acquires the quantized excitation signal from the signal obtained by demultiplexing by the demultiplexing module 20, and performs, according to the bit allocation of each subband obtained by the bit allocation acquiring module 22, quantization and decoding to obtain an excitation signal. The bandwidth extension module 24 performs extension on an entire bandwidth according to the excitation signal obtained by the excitation signal decoding module 23. Further, the bandwidth extension module 24 extends an excitation signal of a high frequency band signal using an excitation signal of a low frequency band signal. When quantizing and encoding an excitation signal and an envelope signal, the excitation quantizing and encoding module 15 and the envelope quantizing and encoding module 12 use most bits to quantize a signal of the relatively important low frequency band signal, and use only a few bits to quantize a signal of the high frequency band signal that may even exclude the excitation signal of the high frequency band signal. Therefore, the bandwidth extension module 24 needs to use the excitation signal of the low frequency band signal to extend the excitation signal of the high frequency band signal in order to obtain an excitation signal of an entire frequency band. The frequency domain signal restoring module 25 is separately connected to the frequency envelope decoding module 21 and the bandwidth extension module 24, and the frequency domain signal restoring module 25 restores a frequency domain signal according to the frequency envelope obtained by the frequency envelope decoding module 21 and the excitation signal that is of the entire frequency band and is obtained by the bandwidth extension module 24. The frequency-time transforming module 26 transforms the frequency domain signal restored by the frequency domain signal restoring module 25 into a time domain signal, thereby obtaining an originally input audio signal.

FIG. 1 and FIG. 2 are structural diagrams of an encoding device and a corresponding decoding device. According to processing processes of the encoding device and the decoding device shown in FIG. 1 and FIG. 2, it may be learned that in the other approaches, an excitation signal and envelope information that are of a low frequency band signal and are used when the decoding device restores a frequency domain signal of the low frequency band signal are sent from the side of the encoding device. Therefore, restoration of the frequency domain signal of the low frequency band signal is relatively accurate. For a frequency domain signal of a high frequency band signal, there is a need to first use the excitation signal of the low frequency band signal to predict an excitation signal of the high frequency band signal, and then use envelope information that is of the high frequency band signal and sent from the side of the encoding device to modify the predicted excitation signal of the high frequency band signal in order to obtain the frequency domain signal of the high frequency band signal. When predicting the frequency domain signal of the high frequency band signal, the encoding device does not consider a signal type and uses a same frequency envelope. For example, when the signal type is a harmonic signal, a subband range covered by the used frequency envelope is relatively narrow (less than a subband range covered from a crest to a valley of one harmonic). When the frequency envelope is used to modify the predicted excitation signal of the high frequency band signal, more noises are brought in, therefore a relatively large error exists between the high frequency band signal obtained by modification and an actual high frequency band signal, severely affecting an accuracy rate of predicting the high frequency band signal, and reducing quality of the predicted high frequency band signal and reducing auditory quality of an audio signal. In addition, using the foregoing other approaches in which an excitation signal of a high frequency band signal is predicted according to an excitation signal of a low frequency band signal, excitation signals of different low frequency band signals may be copied into a same high frequency band signal of different frames, causing discontinuity of excitation signal, reducing quality of the predicted high frequency band signal, and thereby reducing auditory quality of an audio signal. Therefore, the following technical solutions of embodiments of the present disclosure may be used to resolve the foregoing technical problem.

Figure 3:
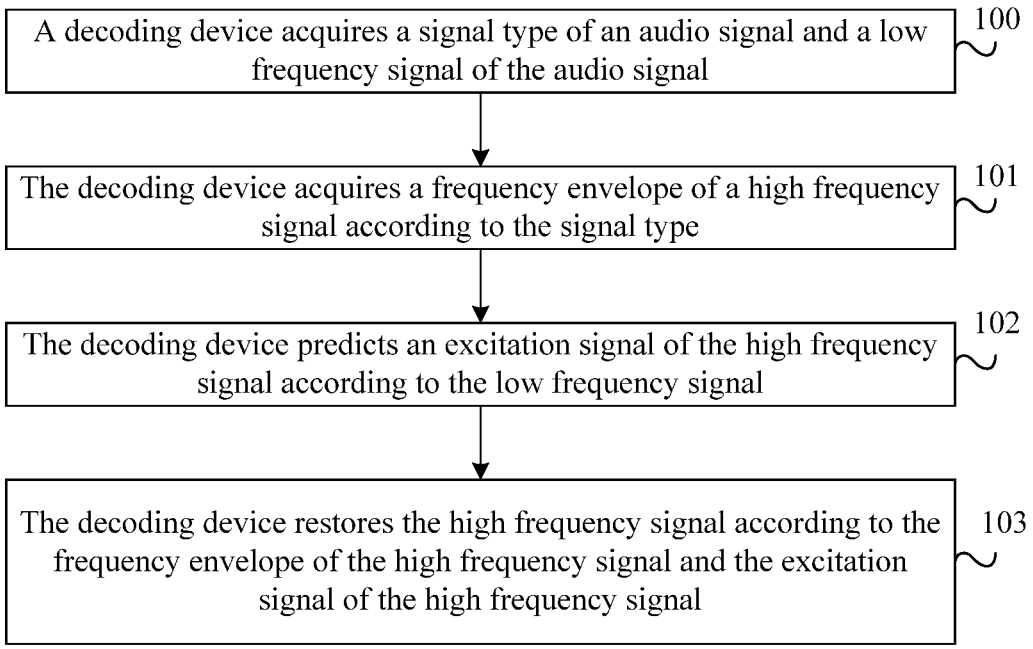
FIG. 3 is a flowchart of a method for predicting a high frequency band signal according to an embodiment of the present disclosure.

FIG. 3 is a flowchart of a method for predicting a high frequency band signal according to an embodiment of the present disclosure. In this embodiment, the method for predicting a high frequency band signal may be executed by a decoding device. As shown in FIG. 3, in this embodiment, the method for predicting a high frequency band signal may include the following steps.

Step 100. The decoding device acquires a signal type of an audio signal and a low frequency band signal of the audio signal.

In this embodiment, the signal type is a harmonic signal or a non-harmonic signal, and the audio signal includes the low frequency band signal and a high frequency band signal. In an embodiment, a signal type of an audio signal is a signal type of a high frequency band signal of the audio signal, that is, whether the high frequency band signal is a harmonic signal or a non-harmonic signal.

Step 101. The decoding device acquires a frequency envelope of a high frequency band signal according to the signal type.

Step 102. The decoding device predicts an excitation signal of the high frequency band signal according to the low frequency band signal.

Step 103. The decoding device restores the high frequency band signal according to the frequency envelope of the high frequency band signal and the excitation signal of the high frequency band signal.

In this embodiment, the high frequency band signal obtained by prediction is a frequency domain signal.

According to the method for predicting a high frequency band signal in this embodiment, a frequency envelope of a high frequency band signal is acquired according to a signal type, and for a signal of a different type, a different spectrum coefficient is used to decode an envelope such that excitation that is of a high frequency band harmonic signal and predicted according to a low frequency band signal can maintain an original harmonic characteristic, thereby avoiding bringing in excessive noises in a prediction process, effectively reducing an error existing between a high frequency band signal obtained by prediction and an actual high frequency band signal, and increasing an accuracy rate of the predicted high frequency band signal.

Optionally, on the basis of the technical solution of the foregoing embodiment, an extension embodiment that is of the embodiment shown in FIG. 3 and is formed by the following extension technical solution may also be included. In this extension embodiment, in step 101, that "the decoding device acquires a frequency envelope of a high frequency band signal according to the signal type" may further include the following two cases.

In the first case, when the signal type is a non-harmonic signal, the decoding device decodes a received bitstream to obtain the frequency envelope of the high frequency band signal, when the signal type is a harmonic signal, the decoding device decodes the received bitstream to obtain an initial frequency envelope of the high frequency band signal, and uses a value obtained by performing weighting calculation on the initial frequency envelope and N adjacent initial frequency envelopes as the frequency envelope of the high frequency band signal, where N is greater than or equal to 1.

In this case, regardless of a harmonic signal or a non-harmonic signal, the frequency envelope that is of the high frequency band signal and is obtained by decoding the received bitstream by the decoding device is the same. For a non-harmonic signal, the frequency envelope that is of the high frequency band signal and is obtained by decoding is the frequency envelope that is of the high frequency band signal and needs to be obtained. For a harmonic signal, the frequency envelope that is of the high frequency band signal and is obtained by decoding by the decoding device is the initial frequency envelope of the high frequency band signal, and there is a need to further use the value obtained by performing weighting calculation on the initial frequency envelope and the N adjacent initial frequency envelopes as the frequency envelope of the high frequency band signal, where N is greater than or equal to 1. In this way, it may be learned that a width of a subband covered by a frequency envelope that is of a high frequency band signal and corresponds to a harmonic signal is wider than that covered by a frequency envelope that is of a high frequency band signal and corresponds to a non-harmonic signal.

A value of N may be determined according to a width of a subband covered by a frequency envelope of a high frequency band signal of a harmonic signal and a width of a subband covered by a frequency envelope of a high frequency band signal of a non-harmonic signal. For example, in the foregoing embodiment, when the signal type is a harmonic signal, there are 40 spectrum coefficients in each subband, and when the signal type is a non-harmonic signal, there are 24 spectrum coefficients in each subband. If the decoding device determines that the signal type is a harmonic signal, and the frequency envelope that is of the high frequency band signal and carried in the bitstream is a frequency envelope corresponding to a non-harmonic signal, in this case, two adjacent frequency envelopes in the bitstream may be averaged to obtain a frequency envelope corresponding to the harmonic signal.

For example, for an ultra-wideband signal, there are 240 spectrum coefficients within a range 8 kilohertz (kHz)-14 kHz. When the signal type is a harmonic signal, the 240 spectrum coefficients may be equally classified into six subbands, there are 40 spectrum coefficients in each subband, one frequency envelope is calculated for each subband, and six frequency envelopes are calculated in total. However, when the signal type is a non-harmonic signal, the 240 spectrum coefficients are equally classified into ten subbands, there are 24 spectrum coefficients in each subband, one frequency envelope is calculated for each subband, and 10 frequency envelopes are calculated in total.

In the second case, a bitstream is decoded according to the signal type to acquire the corresponding frequency envelope of the high frequency band signal, where the bitstream includes the signal type and an encoding index that is of the frequency envelope of the high frequency band signal and corresponds to the signal type.

In the foregoing first implementation case of step 101, the decoding device needs to obtain the signal type of the audio signal, that is, information about a harmonic signal or a non-harmonic signal. There may be different implementation manners. In one implementation manner, an encoding device determines the signal type of the audio signal, encodes the signal type, and transmits the encoded signal type to the decoding device. In the other implementation manner, the decoding device determines the type of the audio signal according to the low frequency band signal obtained by decoding. Herein, the signal type of the audio signal may further refer to a signal type of the high frequency band signal of the audio signal, that is, whether the high frequency band signal is a harmonic signal or a non-harmonic signal.

The harmonic signal indicates a signal whose frequency spectrum amplitude fluctuates sharply in a to-be-processed frequency band, and may represent that a particular quantity of amplitude peaks exist in a particular frequency band. An existing method may be used by an encoder side or a decoder side to determine whether the audio signal is a harmonic signal or a non-harmonic signal. For example, in a method, a frequency domain signal is divided into N subbands, a peak-to-average ratio (the peak-to-average ratio is a ratio of a spectrum coefficient whose amplitude is the largest in a subband to an average value of amplitudes in the subband) of each subband is calculated, and when the peak-to-average ratio is greater than a given threshold by a quantity of subbands, and the quantity of subbands is greater than a given value, in this case, the signal is a harmonic signal, otherwise, the signal is a non-harmonic signal.

Step 100 of FIG. 3, "the decoding device acquires a signal type of an audio signal and a low frequency band signal of the audio signal" may further include the following two manners.

In the first manner, the decoding device decodes the received bitstream to obtain the signal type and the low frequency band signal. It should be noted that a quantization parameter of the low frequency band signal may be used to uniquely identify the low frequency band signal. Therefore, decoding the received bitstream to obtain the low frequency band signal may also be acquiring the quantization parameter of the low frequency band signal.

In this case, the bitstream that is sent by the encoding device and received by the decoding device carries the signal type, the quantization parameter of the low frequency band signal and the frequency envelope of the high frequency band signal. In this case, regardless of a harmonic signal or a non-harmonic signal, the frequency envelope of the high frequency band signal is the same. Correspondingly, whether the signal type is a harmonic signal or a non-harmonic signal is determined by a side of the encoding device. However, the encoding device does not adjust the frequency envelope of the high frequency band signal according to the signal type, instead, the encoding device determines the frequency envelope of the high frequency band signal according to an original audio signal. Meanwhile, the encoding device needs to further determine the low frequency band signal. Then, the encoding device sends, to the decoding device, the bitstream that carries the signal type, and encoding indices of the low frequency band signal and the frequency envelope of the high frequency band signal. Generally, a harmonic attribute of a high frequency band signal is consistent with that of a low frequency band signal, however, a special case also exists in which the harmonic attribute of the low frequency band signal is strong, and the high frequency band signal possibly has no harmonic. Therefore, in this embodiment, the signal type that is of the audio signal and is obtained by the encoding device may be the signal type of the high frequency band signal, or may be a signal type of the low frequency band signal. The former manner is more accurate compared with the latter case.

In the second manner, the decoding device demultiplexes the bitstream to acquire the low frequency band signal, and determines the signal type according to the low frequency band signal.

Compared with the foregoing first manner, in this manner, the signal type is not carried in the bitstream that is sent by the encoding device and is received by the decoding device, instead, the signal type is determined by the decoding device according to the low frequency band signal acquired by demultiplexing. Similarly, the quantization parameter of the low frequency band signal may be used to uniquely identify the low frequency band signal. Optionally, in this manner, the bitstream sent by the encoding device may also carries only encoding indices of the low frequency band signal and the frequency envelope of the high frequency band signal. After receiving the bitstream, the decoding device demultiplexes the bitstream to acquire the low frequency band signal, and determines the signal type according to the low frequency band signal. When this manner is applied on the side of the encoding device, the other approaches may be used. That is, there is no need to determine the signal type, and the bitstream sent to the decoding device does not carry the signal type. For details about processing on the side of the encoding device, refer to the related other approaches. Details are not described herein again. Compared with the former manner, this implementation manner can further reduce encoding bits.

For the foregoing second implementation case of step 101, the decoding device needs to decode the bitstream according to the signal type to acquire the corresponding frequency envelope of the high frequency band signal, that is, the frequency envelope of the high frequency band signal needs to be encoded into the bitstream according to the signal type on the side of the corresponding encoding device. For example, when the signal type is a harmonic signal, the encoding device may use 4 bits to encode the frequency envelope of the high frequency band signal, and when the signal type is a non-harmonic signal, the encoding device may use 5 bits to encode the frequency envelope of the high frequency band signal. Therefore, in this case, the bitstream received by the decoding device needs to carry the signal type. Therefore, in the second case of step 101, the foregoing second manner cannot be used to implement step 100.

Optionally, in the extension embodiment of the embodiment shown in FIG. 3, step 102 that "the decoding device predicts an excitation signal of the high frequency band signal according to the low frequency band signal" may be further implemented using a related conventional technology, or preferably, may be further implemented using the following steps.

(1) The decoding device determines a highest frequency bin, to which a bit is allocated, of the low frequency band signal.

For example, the decoding device may determine the highest frequency bin to which a bit is allocated according to the low frequency band signal in the received bitstream sent by the encoding device. When the quantization parameter of the low frequency band signal is used to uniquely identify the low frequency band signal, the highest frequency bin to which a bit is allocated may be determined according to the quantization parameter of the low frequency band signal. For example, in this embodiment, $f_{last_sfm}$ is used to indicate the highest frequency bin to which a bit is allocated.

(2) The decoding device determines whether the highest frequency bin, to which a bit is allocated, of the low frequency band signal is less than a preset start frequency bin of bandwidth extension of the high frequency band signal, when the highest frequency bin, to which a bit is allocated, of the low frequency band signal is less than the preset start frequency bin of the bandwidth extension of the high frequency band signal, perform step (3), otherwise, when the highest frequency bin, to which a bit is allocated, of the low frequency band signal is greater than or equal to the preset start frequency bin of the bandwidth extension of the high frequency band signal, perform step (4).

(3) The decoding device predicts the excitation signal of the high frequency band signal according to an excitation signal that falls within a predetermined frequency band range and in the low frequency band signal and the preset start frequency bin of the bandwidth extension of the high frequency band signal.

(4) The decoding device predicts the excitation signal of the high frequency band signal according to an excitation signal that falls within a predetermined frequency band range and in the low frequency band signal, the preset start frequency bin of the bandwidth extension of the high frequency band signal, and the highest frequency bin, to which a bit is allocated, of the low frequency band signal.

Further optionally, step (3) that the decoding device predicts the excitation signal of the high frequency band signal according to an excitation signal that falls within a predetermined frequency band range and in the low frequency band signal and the preset start frequency bin of the bandwidth extension of the high frequency band signal includes making n copies of the excitation signal within the predetermined frequency band range, and using the n copies of the excitation signal as an excitation signal between the preset start frequency bin of the bandwidth extension of the high frequency band signal and a highest frequency bin of the bandwidth extension frequency band.

In this embodiment, n is a positive integer or a positive decimal, and n is equal to a ratio of a quantity of frequency bins between the preset start frequency bin of the bandwidth extension of the high frequency band signal and the highest frequency bin of the bandwidth extension frequency band to a quantity of frequency bins within the predetermined frequency band range.

For example, in this embodiment, $f_{bwe_start}$ may be used to indicate the preset start frequency bin of the bandwidth extension of the high frequency band signal. Selection of the $f_{bwe_start}$ is related to an encoding rate (that is, the total quantity of bits). A higher encoding rate indicates that a higher preset start frequency bin $f_{bwe_start}$ of the bandwidth extension of the high frequency band signal can be selected. For example, for an ultra-wideband signal, when the encoding rate is 24 kilobits per second (kbps), the preset start frequency bin $f_{bwe_start}$ of the bandwidth extension of the high frequency band signal is equal to 6.4 kHz, and when the encoding rate is 32 kbps, the preset start frequency bin $f_{bwe_start}$ of the bandwidth extension of the high frequency band signal is equal to 8 kHz.

For example, in this embodiment, the excitation signal that falls within the predetermined frequency band range and in the low frequency band signal may be indicated as an excitation signal that falls within a frequency band range from $f_{exc_start}$ to $f_{exc_end}$ and in the low frequency band signal, where the $f_{exc_start}$ is a start frequency bin that is of the predetermined frequency band range and in the low frequency band signal, the $f_{exc_end}$ is an end frequency that is of the predetermined frequency band range and in the low frequency band signal, and the $f_{exc_end}$ is greater than the $f_{exc_start}$. Selection of the predetermined frequency band range from the $f_{exc_start}$ to the $f_{exc_end}$ is related to the signal type and the encoding rate. For example, in the case of a relatively low rate, for a harmonic signal, a relatively low frequency band signal with relatively good encoding in low frequency band signals is selected, and for a non-harmonic signal, a relatively high frequency band signal with relatively poor encoding in the low frequency band signals is selected. In the case of a relatively high rate, for a harmonic signal, a relatively high frequency band signal in the low frequency band signals may be selected.

For example, in this embodiment, the highest frequency bin of the bandwidth extension frequency band may be indicated as $f_{top_sfm}$.

In this case, n copies of the excitation signal within the frequency band range from the $f_{exc_start}$ to the $f_{exc_end}$ are used as an excitation signal between the $f_{bwe_start}$ and the $f_{top_sfm}$, where n is equal to a ratio of a quantity of frequency bins between the $f_{bwe_start}$ and the $f_{top_sfm}$ to a quantity of frequency bins within the range from the $f_{exc_start}$ to the $f_{exc_end}$, and may be a positive integer or a positive decimal.

In this embodiment, that the decoding device, starting from the $f_{bwe_start}$, makes n copies of the excitation signal within the frequency band range from the $f_{exc_start}$ to the $f_{exc_end}$, and uses the n copies of the excitation signal as the excitation signal that is of the high frequency band signal and between the $f_{bwe_start}$ and the $f_{top_sfm}$ may be implemented in the following manner. The decoding device, starting from the $f_{bwe_start}$, successively copies the excitation signal that falls within the frequency band range from the $f_{exc_start}$ to the $f_{exc_end}$ and in a quantity of an integer part of n and copies the excitation signal that falls within the frequency band range from the $f_{exc_start}$ to the $f_{exc_end}$ and in a quantity of a non-integer part of n, and uses the two parts of excitation signals as the high frequency band excitation signal between the $f_{bwe_start}$ and the $f_{top_sfm}$, where the non-integer part of n is less than 1.

In this embodiment, when the low frequency band excitation signal that falls within the frequency band range from the $f_{exe_start}$ to the $f_{exc_end}$ and in the quantity of the integer part of n is being copied, the excitation signal may be copied successively, that is, one copy of the excitation signal within the frequency band range from the $f_{exc_start}$ to the $f_{exc_end}$ is made each time until n copies of the excitation signal within the frequency band range from the $f_{exc_start}$ to the $f_{exc_end}$ are made, or mirror copying (or referred to as fold copying) may be performed, that is, when integer copies of the excitation signal within the frequency band range from the $f_{exc_start}$ to the $f_{exc_end}$ are being made, staggered copying of forward copying (that is, from the $f_{exc_start}$ to the $f_{exc_end}$) and backward copying (that is, from the $f_{exc_end}$ to the $f_{exc_start}$) is successively performed until n copies are complete.

Alternatively, the decoding device may, starting from the $f_{top_sfm}$, make n copies of the excitation signal within the frequency band range from the $f_{exc_start}$ to the $f_{exc_end}$, and use the n copies of the excitation signal as the high frequency band excitation signal between the $f_{bwe_start}$ and $f_{top_sfm}$, which may be further implemented in the following manner. The decoding device, starting from the $f_{top_sfm}$, successively copies the excitation signal that falls within the frequency band range from the $f_{exc_start}$ to the $f_{exc_end}$ and in a quantity of a non-integer part of n and copies the excitation signal that falls within the frequency band range from the $f_{exc_start}$ to the $f_{exc_end}$ and in a quantity of an integer part of n, and uses the two parts of excitation signals as the high frequency band excitation signal between the $f_{bwe_start}$ and the $f_{top_sfm}$, where the non-integer part of n is less than 1.

Further, copying, starting from the $f_{top_sfm}$, the excitation signal that falls within the frequency band range from the $f_{exc_start}$ to the $f_{exe_end}$ and in the quantity of the non-integer part of n belongs to copying by block. For example, a highest frequency bin of the high frequency band signal is 14 kHz, and the $f_{exc_start}$ to the $f_{exc_end}$ is 1.6 kHz to 4 kHz. When an excitation signal of 0.5 copies of the $f_{exc_start}$ to the $f_{exc_end}$, that is, from 1.6 kHz to 2.8 kHz, is to be selected, using the solution of this step, the excitation signal from 1.6 kHz to 2.8 kHz may be copied into a bandwidth extension frequency band between (14-1.2) kHz and 14 kHz and used as an excitation signal of this high frequency band signal. In this case, 1.6 kHz is correspondingly copied into (14-1.2) kHz, and 2.8 kHz is correspondingly copied into 14 kHz.

In the foregoing two manners, regardless of starting to perform copying from the $f_{bwe_start}$ or the $f_{top_sfm}$, results of the high frequency band excitation signal that is between the $f_{bwe_start}$ and the $f_{top_sfm}$ and is finally obtained by prediction are the same.

In an implementation process of the foregoing solution, a ratio n may first be calculated by dividing the quantity of frequency bins between the $f_{bwe_start}$ and the $f_{top_sfm}$ by the quantity of frequency bins between the $f_{exc_start}$ and the $f_{exc_end}$.

Further optionally, step (4) that the decoding device predicts the excitation signal of the high frequency band signal according to an excitation signal that falls within a predetermined frequency band range and in the low frequency band signal, the preset start frequency bin of the bandwidth extension of the high frequency band signal, and the highest frequency bin, to which a bit is allocated, of the low frequency band signal includes copying an excitation signal from the $m^{th}$ frequency bin above the start frequency bin $f_{exc_start}$ of the predetermined frequency band range to the end frequency bin $f_{exc_end}$ of the predetermined frequency band range and making n copies of the excitation signal within the predetermined frequency band range, and using the two parts of excitation signals as an excitation signal between the highest frequency bin, to which a bit is allocated, of the low frequency band signal and the highest frequency bin of the bandwidth extension frequency band.

In this embodiment, n is 0, a positive integer, or a positive decimal, and m is a quantity of frequency bins between the highest frequency bin, to which a bit is allocated, of the low frequency band signal and the preset start frequency bin of the extension frequency band, and may be indicated as $(f_{last_sfm}-f_{bwe_start})$.

In this case, an excitation signal from the $(f_{last_sfm}-f_{bwe_start})^{th}$ frequency greater than the $f_{exc_start}$ to the $f_{exc_end}$ is copied and n copies of the excitation signal within the frequency band range from the $f_{exc_start}$ to the $f_{exc_end}$ are made, and the two parts of excitation signals are used as the excitation signal between the $f_{last_sfm}$ and the $f_{top_sfm}$, where n may be 0, a positive integer, or a positive decimal.

During specific implementation, the decoding device may, starting from the $f_{last_sfm}$, successively copy an excitation signal within a frequency band range from $(f_{exc_start}+(f_{last_sfm}-f_{bwe_start}))$ to the $f_{exc_end}$, the excitation signal that is from the $f_{exc_start}$ to the $f_{exc_end}$ and in the quantity of the integer part of n, and the excitation signal that falls within the frequency band range from the $f_{exc_start}$ to the $f_{exc_end}$ and in the quantity of the non-integer part of n, and use the three parts of excitation signals as the high frequency band excitation signal between the $f_{last_sfm}$ and the $f_{top_sfm}$, where the non-integer part of n is less than 1.

Alternatively, the decoding device may, starting from the $f_{top_sfm}$, successively make n copies of the excitation signal from the $f_{exc_start}$ to the $f_{exc_end}$ and copy an excitation signal within a frequency band range from $(f_{exc_start}+(f_{last_sfm}-f_{bwe_start}))$ to the $f_{exc_end}$, and use the two parts of excitation signals as the high frequency band excitation signal between the $f_{last_sfm}$ and the $f_{top_sfm}$, where similarly, n is 0, a positive integer, or a positive decimal.

During specific implementation, the decoding device may, starting from the $f_{top_sfm}$, successively copy the excitation signal that falls within the frequency band range from the $f_{exc_start}$ to the $f_{exc_end}$ and in the quantity of the non-integer part of n, the excitation signal that falls within the frequency band range from the $f_{exc_start}$ to the $f_{exc_end}$ and in the quantity of the integer part of n, and the excitation signal within the frequency band range from the $(f_{exc_start}\ (f_{last_sfm}-f_{bwe_start}))$ to the $f_{exc_end}$, and use the three parts of excitation signals as the high frequency band excitation signal between the $f_{last_sfm}$ and the $f_{top_sfm}$, where the non-integer part of n is less than 1.

When the decoding device starts to perform prediction from the $f_{top_sfm}$, copying the excitation signal that falls within the frequency band range from the $f_{exc_start}$ to the $f_{exc_end}$ and in the quantity of the non-integer part of n also belongs to copying by block. An excitation signal corresponding to a low frequency bin within a low frequency band range is located on a corresponding low frequency bin in a high frequency band, and an excitation signal corresponding to a high frequency bin within a low frequency band range is located on a corresponding high frequency bin in a high frequency band. For details, refer to the foregoing related records. Similarly, copying of the low frequency band excitation signal that falls within the frequency band range from the $f_{exc_start}$ to the $f_{exc_end}$ and in the quantity of the integer part of n may also be successive copying or mirror copying. For details, refer to the foregoing related records. Details are not described herein again.

In the foregoing two manners, regardless of starting to predict the high frequency band excitation signal between the $f_{last_sfm}$ and the $f_{top_sfm}$ from the $f_{last_sfm}$ or the $f_{top_sfm}$, results of the high frequency band excitation signal that is between the $f_{last_sfm}$ and the $f_{top_sfm}$ and is finally obtained by prediction are the same.

In addition, in the foregoing solution, when a bandwidth from the $(f_{exc_start}+(f_{last_sfm}-f_{bwe_start}))$ to the $f_{exc_end}$ is greater than or equal to the quantity of frequency bins between the $f_{last_sfm}$ and the $f_{top_sfm}$, there is only a need to acquire, starting from the $(f_{exc_start}+(f_{last_sfm}-f_{bwe_start}))$ in the bandwidth from the $(f_{exc_start}+(f_{last_sfm}-f_{bwe_start}))$ to the $f_{exc_end}$, an excitation signal whose frequency bin range is from the $f_{last_sfm}$ to the $f_{top_sfm}$ and use the excitation signal as the excitation signal between the $f_{last_sfm}$ and the $f_{top_sfm}$.

In an implementation process of the foregoing solution, a ratio, that is, n, may first be calculated to acquire by dividing a difference between the $(f_{exc_start}+(f_{last_sfm}-f_{bwe_start}))$ and the quantity of frequency bins between the $f_{last_sfm}$ and the $f_{top_sfm}$ by the quantity of frequency bins between the $f_{exc_start}$ and the $f_{exc_end}$, where n may be 0, a positive integer, or a positive decimal.

For example, when the encoding rate is 24 kbps, the $f_{bwe_start}$ is equal to 6.4 kHz, and the $f_{top_sfm}$ is 14 kHz. The excitation signal of the high frequency band signal is predicted in the following manner. It is assumed that an extension range of a preselected low frequency band signal is 0 kHz-4 kHz, and a highest frequency $f_{last_sfm}$, on which a bit is allocated, in the $N^{th}$ frame is 8 kHz, in this case, the $f_{last_sfm}$ is greater than the $f_{bwe_start}$. Therefore, first self-adaptive normalization processing is performed on a selected excitation signal of the low frequency band signal whose extension range is 0 kHz-4 kHz (for a specific process of self-adaptive normalization processing, refer to the records in the foregoing embodiment, details are not described herein again), and then, an excitation signal of a high frequency band signal greater than 8 kHz is predicted according to the normalized excitation signal of the low frequency band signal. According to the manner in the foregoing embodiment, a sequence for copying the selected normalized excitation signal of the low frequency band signal is as follows. First, an excitation signal within a low frequency band range from (8 kHz-6.4 kHz) to 4 kHz is copied, then, an excitation signal within 0.9 copies of the low frequency band range from the $f_{exc_start}$ to the $f_{exc_end}$ (0 kHz-4 kHz) is copied, that is, an excitation signal within a low frequency band range from 0 kHz to 3.6 kHz is copied, and the two parts of excitation signals are used as a high frequency band excitation signal between the highest frequency ($f_{last_sfm}$=8 kHz) on which a bit is allocated and the highest frequency $f_{top_sfm}$ ($f_{top_sfm}$=14 kHz) of the high frequency band signal. If a highest frequency $f_{last_sfm}$, on which a bit is allocated, in the $(N+1)^{th}$ frame is less than or equal to 6.4 kHz (a preset start frequency bin $f_{bwe_start}$ of the bandwidth extension of the high frequency band signal is equal to 6.4 kHz), self-adaptive normalization processing is performed on the selected excitation signal that is of the low frequency band signal and within a frequency band range 0 kHz-4 kHz, and then, an excitation signal of a high frequency band signal greater than 6.4 kHz is predicted according to the normalized excitation signal of the low frequency band signal. According to the manner in the foregoing embodiment, a sequence for copying the selected normalized excitation signal of the low frequency band signal is as follows. First, one copy of an excitation signal within a low frequency band range from the $f_{ex_start}$ to the $f_{exc_end}$ (0 kHz-4 kHz) is made, then the excitation signal within 0.9 copies of the low frequency band range from the $f_{exe_start}$ to the $f_{exc_end}$ (0 kHz-4 kHz) is copied, and the two parts of excitation signals are used as the high frequency band excitation signal between the preset start frequency bin ($f_{bwe_start}$=6.4 kHz) of the bandwidth extension of the high frequency band signal and the highest frequency $f_{top_sfm}$ ($f_{top_sfm}$=14 kHz) of the high frequency band signal.

The highest frequency bin of the high frequency band signal is determined according to a type of the frequency domain signal. For example, when the type of the frequency domain signal is an ultra-wideband signal, the highest frequency $f_{top_sfm}$ of the high frequency band signal is 14 kHz. Before communicating with each other, generally, the encoding device and the decoding device have determined a type of a to-be-transmitted frequency domain signal, therefore, a highest frequency bin of the frequency domain signal may be considered determined.

According to the method for predicting a high frequency band signal in the foregoing embodiment, using the foregoing technical solution, for a harmonic signal and a non-harmonic signal, different envelope information is used to predict a high frequency band signal, thereby avoiding bringing in excessive noises in a prediction process, effectively reducing an error existing between a high frequency band signal obtained by modification and an actual high frequency band signal, and increasing an accuracy rate of the predicted high frequency band signal.

In addition, it may be found from the foregoing prediction of the excitation signal of the high frequency band signal that although start frequency bins of bandwidth extension in the $N^{th}$ frame and the $(N+1)^{th}$ frame are different, an excitation signal of a same frequency band greater than 8 kHz is obtained by prediction from an excitation signal of a same frequency band of a low frequency band signal, therefore, continuity of frames can be ensured.

Using the technical solution of the foregoing embodiment, continuity of excitation signals that are of high frequency band signals and are predicted in a former frame and a latter frame can be effectively ensured, thereby ensuring auditory quality of a restored high frequency band signal and enhancing auditory quality of an audio signal.

Figure 4:
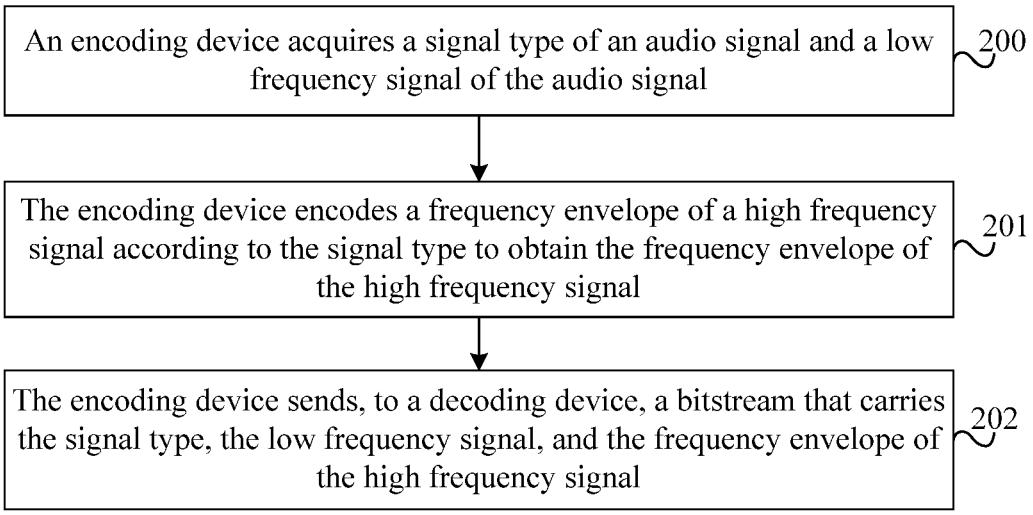
FIG. 4 is a flowchart of a method for predicting a high frequency band signal according to another embodiment of the present disclosure.

FIG. 4 is a flowchart of a method for predicting a high frequency band signal according to another embodiment of the present disclosure. In this embodiment, the method for predicting a high frequency band signal may be executed by an encoding device. As shown in FIG. 4, in this embodiment, the method for predicting a high frequency band signal may further include the following steps.

Step 200. The encoding device acquires a signal type of an audio signal and a low frequency band signal of the audio signal, where the signal type in this embodiment is a harmonic signal or a non-harmonic signal, and the audio signal in this embodiment includes the low frequency band signal and a high frequency band signal.

Step 201. The encoding device encodes a frequency envelope of the high frequency band signal according to the signal type to obtain the frequency envelope of the high frequency band signal.

Step 202. The encoding device sends, to a decoding device, a bitstream that carries the signal type, the low frequency band signal, and the frequency envelope of the high frequency band signal.

In this embodiment, the technical solutions in embodiments of the present disclosure are described on a side of the encoding device, and in this embodiment, the bitstream carries the signal type, and encoding indices of the low frequency band signal and the frequency envelope of the high frequency band signal.

Correspondingly, on a side of the decoding device, the decoding device receives the bitstream, demultiplexes the received bitstream to acquire the signal type and the low frequency band signal, and then decodes the received bitstream according to the signal type to acquire the corresponding frequency envelope of the high frequency band signal. Then, the decoding device predicts an excitation signal of the high frequency band signal according to the low frequency band signal, and restores the high frequency band signal according to the frequency envelope of the high frequency band signal and the excitation signal of the high frequency band signal. Further, this embodiment corresponds to that the bitstream received by the decoding device carries the signal type, and encoding indices of the quantization parameter of the low frequency band signal and the frequency envelope of the high frequency band signal in the foregoing extension embodiment of the embodiment shown in FIG. 3. For details of a specific implementation process, refer to the related records in the foregoing extension embodiment of the embodiment shown in FIG. 3. Details are not described herein again.

According to the method for predicting a high frequency band signal in this embodiment, an encoding device acquires a signal type and a low frequency band signal, encodes a frequency envelope of a high frequency band signal according to the signal type to obtain the frequency envelope of the high frequency band signal, and sends, to a decoding device, a bitstream that carries the signal type, the low frequency band signal, and the frequency envelope of the high frequency band signal such that the decoding device decodes the bitstream to acquire a quantization parameter of the low frequency band signal and the signal type, acquires the frequency envelope of the high frequency band signal according to the signal type, predicts an excitation signal of the high frequency band signal according to the quantization parameter of the low frequency band signal, and then predicts the high frequency band signal according to the frequency envelope of the high frequency band signal and the excitation signal of the high frequency band signal. Using the technical solution in this embodiment, bringing in excessive noises can be avoided in a prediction process, an error existing between a high frequency band signal obtained by prediction and an actual high frequency band signal can be effectively reduced, and an accuracy rate of the predicted high frequency band signal can be increased.

Similarly and optionally, in the technical solution of the foregoing embodiment, in 201, the encoding device encodes the frequency envelope of the high frequency band signal according to the signal type to obtain the frequency envelope of the high frequency band signal. For example, when the signal type is a non-harmonic signal, a first quantity of spectrum coefficients are used to calculate the frequency envelope of the high frequency band signal, and when the signal type is a harmonic signal, a second quantity of spectrum coefficients are used to calculate the frequency envelope of the high frequency band signal, where the second quantity is greater than the first quantity. In this way, a width of a subband covered by the frequency envelope that is of the high frequency band signal and is obtained by encoding by the encoding device when the signal type is a harmonic signal is greater than a width of a subband covered by the frequency envelope that is of the high frequency band signal and is obtained by encoding by the encoding device when the signal type is a non-harmonic signal. For details of a specific implementation process, refer to FIG. 3 and the records in the foregoing extension embodiment of the embodiment shown in FIG. 3. Details are not described herein again.

Figure 5:
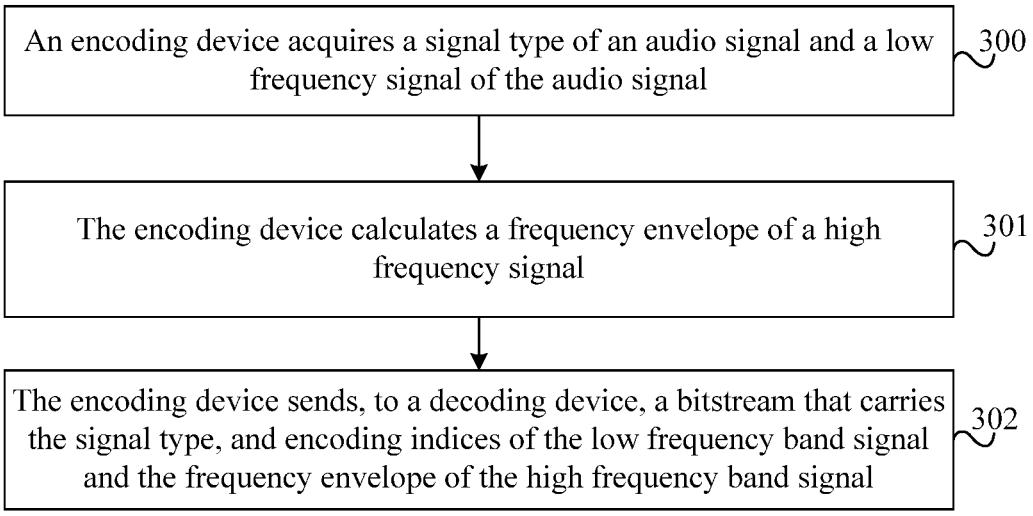
FIG. 5 is a flowchart of a method for predicting a high frequency band signal according to still another embodiment of the present disclosure.

FIG. 5 is a flowchart of a method for predicting a high frequency band signal according to still another embodiment of the present disclosure. In this embodiment, the method for predicting a high frequency band signal may be executed by an encoding device. As shown in FIG. 5, in this embodiment, the method for predicting a high frequency band signal may further include the following steps.

Step 300. The encoding device acquires a signal type of an audio signal and a low frequency band signal of the audio signal.

In this embodiment, the signal type is a harmonic signal or a non-harmonic signal, and the audio signal includes the low frequency band signal and a high frequency band signal.

Step 301. The encoding device calculates a frequency envelope of a high frequency band signal.

In this embodiment, a method for calculating a frequency envelope of a high frequency band signal of a harmonic signal is the same as that of a non-harmonic signal.

Step 302. The encoding device sends, to a decoding device, a bitstream that carries the signal type, and encoding indices of the low frequency band signal and the frequency envelope of the high frequency band signal.

Similarly, in this embodiment, the technical solutions in embodiments of the present disclosure are described on the side of the encoding device, and in this embodiment, the bitstream carries the signal type, and encoding indices of the low frequency band signal and the frequency envelope of the high frequency band signal.

Correspondingly, on the side of the decoding device, the decoding device receives the bitstream, demultiplexes the received bitstream to acquire the signal type and the low frequency band signal, and then acquires the frequency envelope of the high frequency band signal according to the signal type. For example, when the signal type is a non-harmonic signal, the decoding device demultiplexes the received bitstream, decodes the received bitstream to obtain the frequency envelope of the high frequency band signal, and when the signal type is a harmonic signal, the decoding device demultiplexes the received bitstream, decodes the received bitstream to obtain an initial frequency envelope of the high frequency band signal, and uses a value obtained by performing weighting calculation on the initial frequency envelope and N adjacent initial frequency envelopes as the frequency envelope of the high frequency band signal, where N is greater than or equal to 1. Then, the decoding device predicts an excitation signal of the high frequency band signal according to the low frequency band signal, and restores the high frequency band signal according to the frequency envelope of the high frequency band signal and the excitation signal of the high frequency band signal. Further, this embodiment corresponds to the other case in the foregoing extension embodiment of the embodiment shown in FIG. 3. For details of a specific implementation process, refer to FIG. 3 and the related records in the foregoing extension embodiment of the embodiment shown in FIG. 3. Details are not described herein again.

According to the method for predicting a high frequency band signal in this embodiment, an encoding device acquires a signal type of an audio signal and a low frequency band signal of the audio signal, calculates a frequency envelope of a high frequency band signal, and sends, to a decoding device, a bitstream that carries the signal type, and encoding indices of the low frequency band signal and the frequency envelope of the high frequency band signal such that the decoding device demultiplexes the bitstream to acquire the signal type and the low frequency band signal, then acquires the frequency envelope of the high frequency band signal according to the signal type, then predicts an excitation signal of the high frequency band signal according to the low frequency band signal, and restores the high frequency band signal according to the frequency envelope of the high frequency band signal and the excitation signal of the high frequency band signal. Using the technical solution in this embodiment, bringing in excessive noises can be avoided in a prediction process, an error existing between a high frequency band signal obtained by prediction and an actual high frequency band signal can be effectively reduced, and an accuracy rate of the predicted high frequency band signal can be increased.

A person of ordinary skill in the art may understand that all or a part of the steps of the foregoing method embodiments may be implemented by a program instructing relevant hardware. The program may be stored in a computer readable storage medium. When the program runs, the steps of the method embodiments are performed. The foregoing storage medium includes any medium that can store program code, such as a read-only memory (ROM), a random access memory (RAM), a magnetic disk, or an optical disc.

Figure 6:
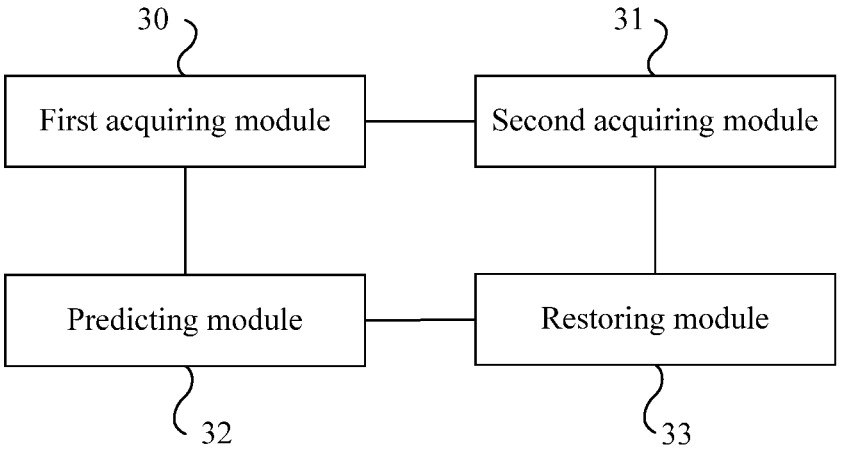
FIG. 6 is a schematic structural diagram of a decoding device according to an embodiment of the present disclosure.

FIG. 6 is a schematic structural diagram of a decoding device according to an embodiment of the present disclosure. As shown in FIG. 6, in this embodiment, the decoding device includes a first acquiring module 30, a second acquiring module 31, a predicting module 32, and a restoring module 33.

The first acquiring module 30 is configured to acquire a signal type of an audio signal and a low frequency band signal of the audio signal, where the signal type is a harmonic signal or a non-harmonic signal, and the audio signal includes the low frequency band signal and a high frequency band signal. The second acquiring module 31 is connected to the first acquiring module 30, and the second acquiring module 31 is configured to acquire a frequency envelope of the high frequency band signal according to the signal type acquired by the first acquiring module 30. The predicting module 32 is connected to the first acquiring module 30, and the predicting module 32 is configured to predict an excitation signal of the high frequency band signal according to the low frequency band signal acquired by the first acquiring module 30. The restoring module 33 is separately connected to the second acquiring module 31 and the predicting module 32, and the restoring module 33 is configured to restore the high frequency band signal according to the frequency envelope that is of the high frequency band signal and acquired by the second acquiring module 31 and the excitation signal that is of the high frequency band signal and is obtained by prediction by the predicting module 32.

The decoding device in this embodiment uses the foregoing modules to implement prediction of a high frequency band signal, which is the same as the implementation process of the foregoing related method embodiments. For details, refer to the records in the foregoing related method embodiments. Details are not described herein again.

The decoding device in this embodiment uses the foregoing modules to implement that for a signal of a different type, a different spectrum coefficient is used to decode an envelope such that excitation signal of a high frequency band harmonic signal predicted according to a low frequency band signal can maintain an original harmonic characteristic, thereby avoiding bringing in excessive noises in a prediction process, effectively reducing an error existing between a high frequency band signal obtained by prediction and an actual high frequency band signal, and increasing an accuracy rate of the predicted high frequency band signal.

Figure 7:
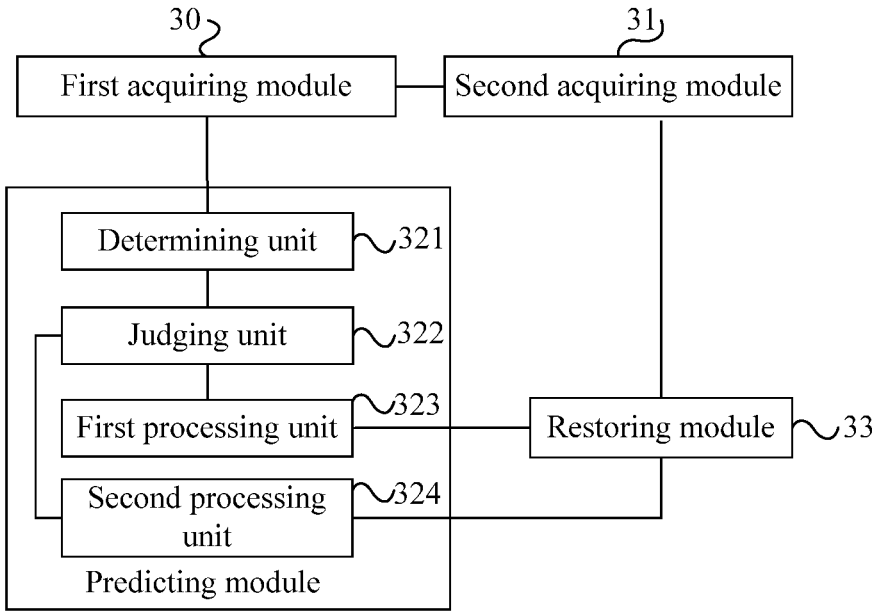
FIG. 7 is a schematic structural diagram of a decoding device according to another embodiment of the present disclosure.

FIG. 7 is a schematic structural diagram of a decoding device according to another embodiment of the present disclosure. In this embodiment, on the basis of the foregoing embodiment shown in FIG. 6, the decoding device may further include the following extension technical solution.

In the decoding device in this embodiment, the second acquiring module 31 is further configured to, when the signal type acquired by the first acquiring module 30 is a non-harmonic signal, demultiplex a received bitstream, and decode the received bitstream to obtain the frequency envelope of the high frequency band signal, or the second acquiring module 31 is further configured to, when the signal type acquired by the first acquiring module 30 is a harmonic signal, demultiplex a received bitstream, decode the received bitstream to obtain an initial frequency envelope of the high frequency band signal, and use a value obtained by performing weighting calculation on the initial frequency envelope and N adjacent initial frequency envelopes as the frequency envelope of the high frequency band signal, where N is greater than or equal to 1.

Optionally, in the decoding device in this embodiment, the second acquiring module 31 is further configured to decode a received bitstream according to the signal type acquired by the first acquiring module 30, to acquire the corresponding frequency envelope of the high frequency band signal.

Optionally, in the decoding device in this embodiment, the first acquiring module 30 is further configured to demultiplex the bitstream to acquire the signal type and the low frequency band signal. In this case, correspondingly, the bitstream that is sent by the encoding device and received by the decoding device carries the signal type, and encoding indices of the low frequency band signal and the frequency envelope of the high frequency band signal.

Optionally, in the decoding device in this embodiment, the first acquiring module 30 is further configured to demultiplex the bitstream to acquire the low frequency band signal, and determines the signal type according to the low frequency band signal.

Optionally, in the decoding device in this embodiment, the predicting module 32 may include a determining unit 321, a judging unit 322, a first processing unit 323, and a second processing unit 324.

The determining unit 321 is connected to the first acquiring module 30, and the determining unit 321 is configured to determine a highest frequency bin, to which a bit is allocated, of the low frequency band signal acquired by the first acquiring module 30. The judging unit 322 is connected to the determining unit 321, and the judging unit 322 is configured to determine whether the highest frequency bin, to which a bit is allocated and which is determined by the determining unit 321, of the low frequency band signal is less than a preset start frequency bin of bandwidth extension of the high frequency band signal. The first processing unit 323 is connected to the judging unit 322, and the first processing unit 323 is configured to when the judging unit 322 determines that the highest frequency bin, to which a bit is allocated, of the low frequency band signal is less than the preset start frequency bin of the bandwidth extension of the high frequency band signal, predict the excitation signal of the high frequency band signal according to an excitation signal that falls within a predetermined frequency band range and in the low frequency band signal and the preset start frequency bin of the bandwidth extension of the high frequency band signal. The second processing unit 324 is also connected to the judging unit 322, and the second processing unit 324 is configured to when the judging unit 322 determines that the highest frequency bin, to which a bit is allocated, of the low frequency band signal is greater than or equal to the preset start frequency bin of the bandwidth extension of the high frequency band signal, predict the excitation signal of the high frequency band signal according to an excitation signal that falls within a predetermined frequency band range and in the low frequency band signal, the preset start frequency bin of the bandwidth extension of the high frequency band signal, and the highest frequency bin, to which a bit is allocated, of the low frequency band signal. In this case, correspondingly, the restoring module 33 is separately connected to the second acquiring module 31, the first processing unit 323, and the second processing unit 324. However, at a same moment, the restoring module 33 can be connected to only either of the first processing unit 323 and the second processing unit 324. When the judging unit 322 determines that the highest frequency bin, to which a bit is allocated, of the low frequency band signal is less than the preset start frequency bin of the bandwidth extension of the high frequency band signal, the restoring module 33 is connected to the first processing unit 323. When the judging unit 322 determines that the highest frequency bin, to which a bit is allocated, of the low frequency band signal is greater than or equal to the preset start frequency bin of the bandwidth extension of the high frequency band signal, the restoring module 33 is connected to the second processing unit 324. The restoring module 33 is further configured to restore the high frequency band signal according to the frequency envelope that is of the high frequency band signal and acquired by the second acquiring module 31 and the excitation signal that is of the high frequency band signal and is obtained by prediction by the first processing unit 323 or the second processing unit 324.

Further optionally, in the decoding device in this embodiment, the first processing unit 323 is further configured to, when the judging unit 322 determines that the highest frequency bin, to which a bit is allocated, of the low frequency band signal is less than the preset start frequency bin of the bandwidth extension of the high frequency band signal, make n copies of the excitation signal within the predetermined frequency band range, and use the n copies of the excitation signal as an excitation signal between the preset start frequency bin of the bandwidth extension of the high frequency band signal and a highest frequency bin of the bandwidth extension frequency band, where n is a positive integer or a positive decimal, and n is equal to a ratio of a quantity of frequency bins between the preset start frequency bin of the bandwidth extension of the high frequency band signal and the highest frequency bin of the bandwidth extension frequency band to a quantity of frequency bins within the predetermined frequency band range. For specific implementation of the first processing unit 323, the technical solution recorded in the foregoing extension embodiment of the embodiment shown in FIG. 3 may be used. Details are not described herein again.

Further optionally, in the decoding device in this embodiment, the second processing unit 324 is further configured to, when the judging unit 322 determines that the highest frequency bin, to which a bit is allocated, of the low frequency band signal is greater than or equal to the preset start frequency bin of the bandwidth extension of the high frequency band signal, copy an excitation signal from the $m^{th}$ frequency bin above a start frequency bin $f_{exc_start}$ of the predetermined frequency band range to an end frequency bin $f_{exc_end}$ of the predetermined frequency band range and make n copies of the excitation signal within the predetermined frequency band range, and use the two parts of excitation signals as an excitation signal between the highest frequency bin, to which a bit is allocated, of the low frequency band signal and a highest frequency bin of the bandwidth extension frequency band, where n is 0, a positive integer, or a positive decimal, and m is a quantity of frequency bins between the highest frequency bin, to which a bit is allocated, of the low frequency band signal and the preset start frequency bin of the extension frequency band. For specific implementation of the second processing unit 324, the technical solution recorded in the foregoing extension embodiment of the embodiment shown in FIG. 3 may be used. Details are not described herein again.

According to the decoding device in this embodiment, a manner in which the foregoing multiple optional embodiments coexist is used to introduce the technical solutions in the present disclosure. In actual reference, the foregoing multiple optional embodiments may be randomly combined to form embodiments of the present disclosure. Details are not described herein again.

The decoding device in this embodiment uses the foregoing modules to implement prediction of a high frequency band signal, which is the same as the implementation process of the foregoing related method embodiments. For details, refer to the records in the foregoing related method embodiments. Details are not described herein again.

The decoding device in this embodiment uses the foregoing modules to use, for a signal of a different type, a different spectrum coefficient to decode an envelope such that excitation signal of a high frequency band harmonic signal predicted according to a low frequency band signal can maintain an original harmonic characteristic, thereby avoiding bringing in excessive noises in a prediction process, effectively reducing an error existing between a high frequency band signal obtained by prediction and an actual high frequency band signal, and increasing an accuracy rate of the predicted high frequency band signal.

Figure 8:
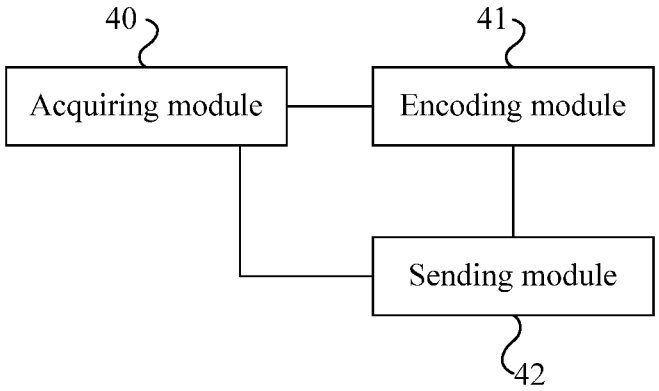
FIG. 8 is a schematic structural diagram of an encoding device according to an embodiment of the present disclosure.

FIG. 8 is a schematic structural diagram of an encoding device according to an embodiment of the present disclosure. As shown in FIG. 8, in this embodiment, the encoding device may include an acquiring module 40, an encoding module 41, and a sending module 42.

The acquiring module 40 is configured to acquire a signal type of an audio signal and a low frequency band signal of the audio signal, where the signal type is a harmonic signal or a non-harmonic signal, and the audio signal includes the low frequency band signal and a high frequency band signal. The encoding module 41 is connected to the acquiring module 40, and the encoding module 41 is configured to encode a frequency envelope of the high frequency band signal according to the signal type acquired by the acquiring module 40, to obtain the frequency envelope of the high frequency band signal. The sending module 42 is separately connected to the acquiring module 40 and the encoding module 41, and the sending module 42 is configured to send, to a decoding device, a bitstream that carries the signal type acquired by the acquiring module 40, and encoding indices of the low frequency band signal acquired by the acquiring module 40 and the frequency envelope of the high frequency band signal and is obtained by encoding by the encoding module 41.

For example, using the foregoing modules, the encoding device may send, to the decoding device, the bitstream that carries the signal type, and encoding indices of the low frequency band signal and the frequency envelope of the high frequency band signal such that the decoding device acquires the signal type of the audio signal and the low frequency band signal of the audio signal, where the signal type is a harmonic signal or a non-harmonic signal, and the audio signal includes the low frequency band signal and the high frequency band signal, acquires the frequency envelope of the high frequency band signal according to the signal type, predicts an excitation signal of the high frequency band signal according to the low frequency band signal, and restores the high frequency band signal according to the frequency envelope of the high frequency band signal and the excitation signal of the high frequency band signal. For details, refer to the records in the foregoing related embodiments. Details are not described herein again.

The encoding device in this embodiment uses the foregoing modules to implement prediction of a high frequency band signal, which is the same as the implementation process of the foregoing related method embodiments. For details, refer to the records in the foregoing related method embodiments. Details are not described herein again.

Using the foregoing modules, the encoding device in this embodiment can conveniently implement that for a signal of a different type, a different spectrum coefficient is used to decode an envelope such that excitation signal of a high frequency band harmonic signal predicted according to a low frequency band signal can maintain an original harmonic characteristic, thereby avoiding bringing in excessive noises in a prediction process, effectively reducing an error existing between a high frequency band signal obtained by prediction and an actual high frequency band signal, and increasing an accuracy rate of the predicted high frequency band signal.

Optionally, on the basis of the foregoing embodiment shown in FIG. 8, the encoding module 41 is further configured to, when the signal type acquired by the acquiring module 40 is a non-harmonic signal, a first quantity of spectrum coefficients are used to calculate the frequency envelope of the high frequency band signal, or the encoding module 41 is further configured to, when the signal type acquired by the acquiring module 40 is a harmonic signal, a second quantity of spectrum coefficients are used to calculate the frequency envelope of the high frequency band signal, where the second quantity is greater than the first quantity.

Figure 9:
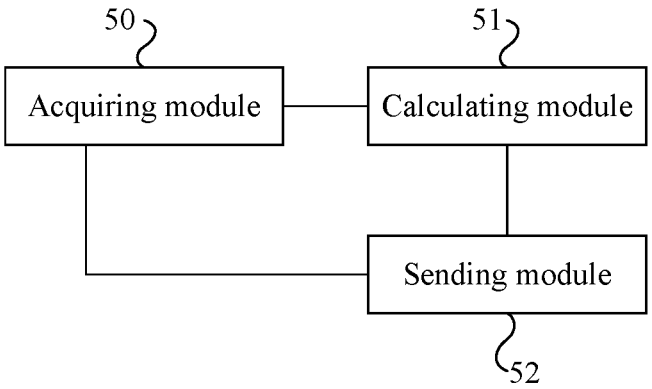
FIG. 9 is a schematic structural diagram of an encoding device according to another embodiment of the present disclosure.

FIG. 9 is a schematic structural diagram of an encoding device according to another embodiment of the present disclosure. As shown in FIG. 9, in this embodiment, the encoding device may include an acquiring module 50, a calculating module 51, and a sending module 52.

The acquiring module 50 is configured to acquire a signal type of an audio signal and a low frequency band signal of the audio signal, where the signal type is a harmonic signal or a non-harmonic signal, and the audio signal includes the low frequency band signal and a high frequency band signal. The calculating module 51 is configured to calculate a frequency envelope of the high frequency band signal, where a method for calculating a frequency envelope of a high frequency band signal of a harmonic signal is the same as that of a non-harmonic signal. The sending module 52 is separately connected to the acquiring module 50 and the calculating module 51, and the sending module 52 is configured to send, to a decoding device, a bitstream that carries the signal type acquired by the acquiring module 50, and encoding indices of the low frequency band signal acquired by the acquiring module 50 and the frequency envelope that is of the high frequency band signal and is obtained by calculation by the calculating module 51.

For example, using the foregoing modules, the encoding device may send, to the decoding device, the bitstream that carries the signal type, and encoding indices of the low frequency band signal and the frequency envelope of the high frequency band signal such that the decoding device acquires the signal type of the audio signal and the low frequency band signal of the audio signal, where the signal type is a harmonic signal or a non-harmonic signal, and the audio signal includes the low frequency band signal and the high frequency band signal, acquires the frequency envelope of the high frequency band signal according to the signal type, predicts an excitation signal of the high frequency band signal according to the low frequency band signal, and restores the high frequency band signal according to the frequency envelope of the high frequency band signal and the excitation signal of the high frequency band signal. For details, refer to the records in the foregoing related embodiments. Details are not described herein again.

The encoding device in this embodiment uses the foregoing modules to implement prediction of a high frequency band signal, which is the same as the implementation process of the foregoing related method embodiments. For details, refer to the records in the foregoing related method embodiments. Details are not described herein again.

Using the foregoing modules, the encoding device in this embodiment can conveniently implement that for a signal of a different type, a different spectrum coefficient is used to decode an envelope such that excitation signal of a high frequency band harmonic signal predicted according to a low frequency band signal can maintain an original harmonic characteristic, thereby avoiding bringing in excessive noises in a prediction process, effectively reducing an error existing between a high frequency band signal obtained by prediction and an actual high frequency band signal, and increasing an accuracy rate of the predicted high frequency band signal.

Figure 10:
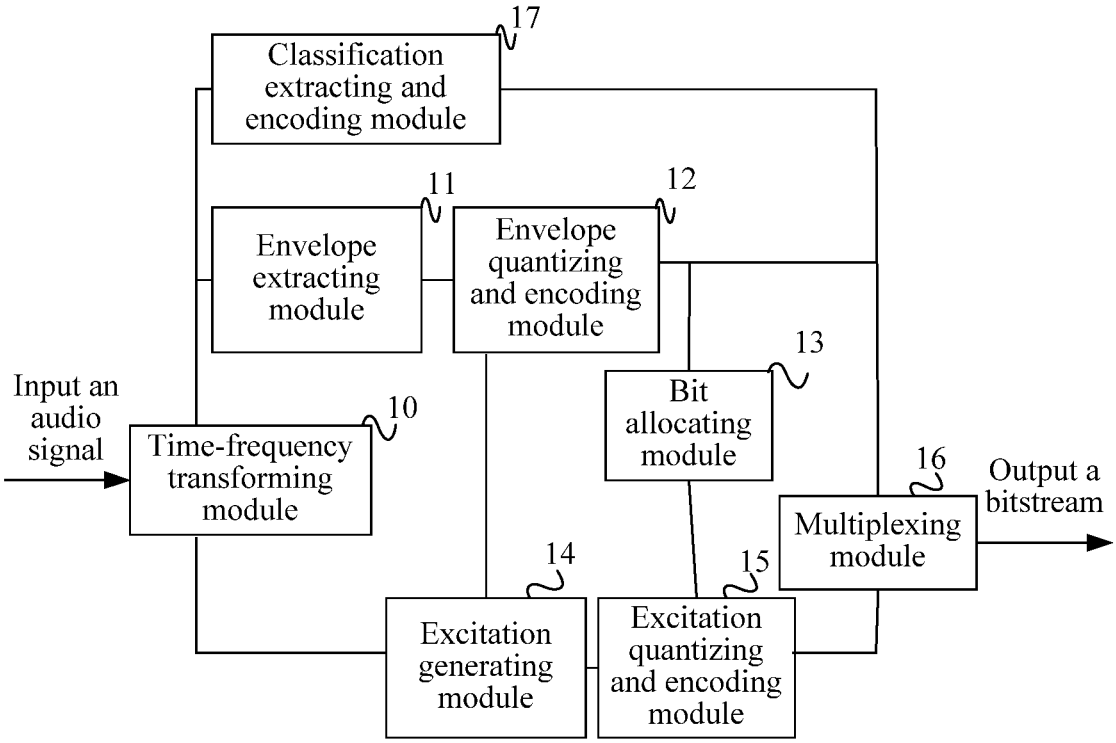
FIG. 10 is an example diagram of an encoding device according to an embodiment of the present disclosure.

FIG. 10 is an example diagram of an encoding device according to an embodiment of the present disclosure. As shown in FIG. 10, in this embodiment, the encoding device is an example diagram of an encoding device formed by adding the technical solutions in embodiments of the present disclosure to the foregoing existing encoding device shown in FIG. 1. As shown in FIG. 10, on the basis of the encoding device shown in FIG. 1, in this embodiment, a classification extracting and encoding module 17 is added to the encoding device.

The classification extracting and encoding module 17 is connected to the time-frequency transforming module 10, and the classification extracting and encoding module 17 is configured to acquire a signal type obtained after conversion by the time-frequency transforming module 10, and encode the frequency envelope that is of the high frequency band signal and quantized by the envelope quantizing and encoding module 12. Herein, the signal type may be a harmonic signal or a non-harmonic signal. The classification extracting and encoding module 17 is further connected to the multiplexing module 16, and in this case, the multiplexing module 16 is configured to separately multiplex the signal type acquired by the classification extracting and encoding module 17, an encoding index obtained by encoding the frequency envelope of the high frequency band signal according to the signal type, and the excitation signal quantized by the excitation quantizing and encoding module 15 into a bitstream, and output the bitstream to a decoding device. The rest is the same as that in the foregoing embodiment shown in FIG. 1. For details, refer to the records in the foregoing related embodiment. Details are not described herein again.

For specific implementation of the technical solution of the encoding device in this embodiment, refer to the records in the foregoing embodiments shown in FIG. 1, FIG. 4, and FIG. 6. Details are not described herein again.

The encoding device in this embodiment uses the foregoing technical solution to acquire different envelope information for a harmonic signal and a non-harmonic signal and send the envelope information to a decoding device such that the decoding device uses different for a harmonic signal and a non-harmonic signal to modify a predicted excitation signal of a high frequency band signal, thereby avoiding bringing in excessive noises in a modification process, effectively reducing an error existing between a high frequency band signal obtained by modification and an actual high frequency band signal, and increasing an accuracy rate of the predicted high frequency band signal.

Optionally, in the foregoing embodiment shown in FIG. 10, a calculating module may further be added. The calculating module is configured to calculate the frequency envelope of the high frequency band signal, where a method for calculating a frequency envelope of a high frequency band signal of a harmonic signal is the same as that of a non-harmonic signal. In this case, the classification extracting and encoding module 17 does not encode, according to the signal type, the frequency envelope that is of the high frequency band signal and quantized by the envelope quantizing and encoding module 12. Implementation of envelope quantization and encoding is the same as that in the foregoing embodiment shown in FIG. 10. For specific implementation of the technical solution of the encoding device in this embodiment, refer to the records in the foregoing embodiments shown in FIG. 1, FIG. 5, and FIG. 7. Details are not described herein again.

Figure 11:
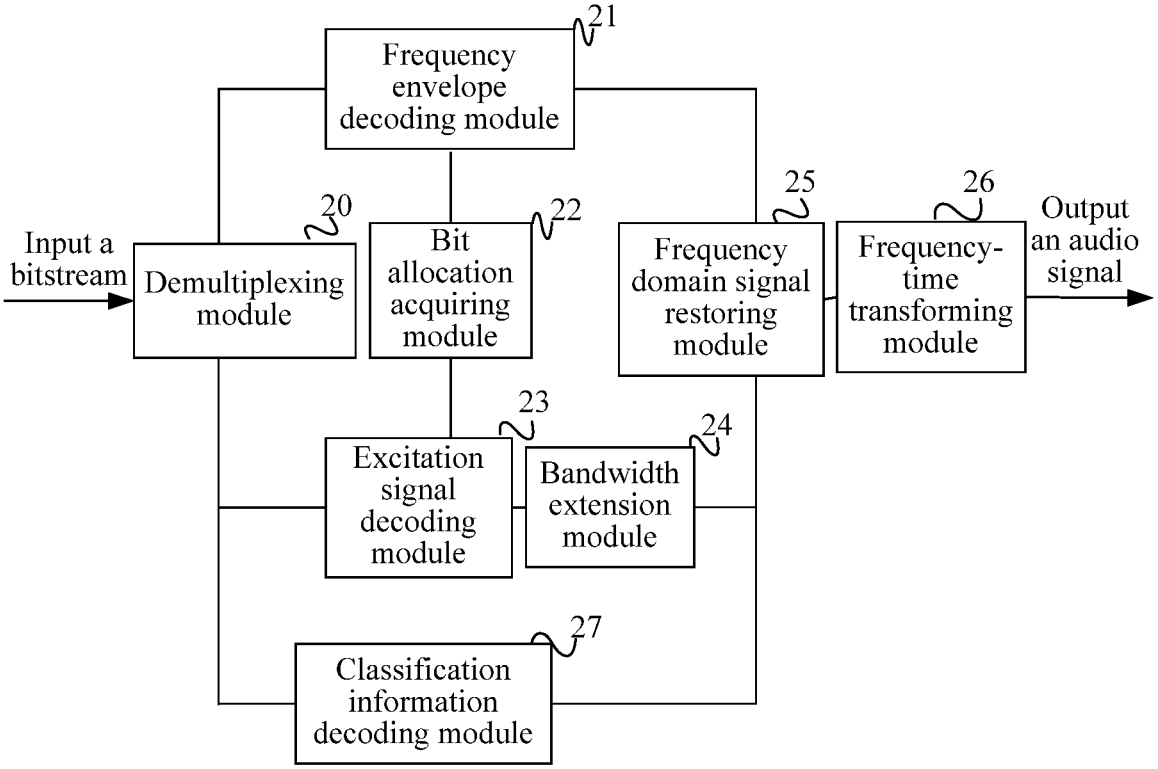
FIG. 11 is an example diagram of a decoding device according to an embodiment of the present disclosure.

FIG. 11 is an example diagram of a decoding device according to an embodiment of the present disclosure. As shown in FIG. 11, in this embodiment, the decoding device is an example diagram of a decoding device formed by adding the technical solutions in embodiments of the present disclosure to the foregoing existing decoding device shown in FIG. 2. As shown in FIG. 11, on the basis of the decoding device shown in FIG. 2 in the other approaches, in this embodiment, a classification information decoding module 27 is added to the decoding device.

The classification information decoding module 27 is configured to acquire a signal type from a received bitstream. The frequency domain signal restoring module 25 is further connected to the classification information decoding module 27, and the frequency domain signal restoring module 25 restores the frequency domain signal according to the signal type obtained by the classification information decoding module 27, the frequency envelope obtained by the frequency envelope decoding module 21, and the excitation signal that is of the entire frequency band and is obtained by the bandwidth extension module 24.

Meanwhile, in this embodiment, for extending the entire bandwidth by the bandwidth extension module 24 according to the excitation signal obtained by the excitation signal decoding module 23, that is, extending the excitation signal of the high frequency band signal using the excitation signal of the low frequency band signal, the method that is for predicting the excitation signal of the high frequency band signal according to the low frequency band signal and is recorded in the foregoing extension embodiment of the embodiment shown in FIG. 3 may be used. For details, refer to the records in the foregoing related embodiments. Details are not described herein again.

Using the foregoing solution, the decoding device in this embodiment can effectively ensure continuity of excitation signals that are of high frequency band signals and are predicted in a former frame and a latter frame, meanwhile, for a harmonic signal and a non-harmonic signal, use different envelope information to modify a predicted excitation signal of a high frequency band signal, thereby avoiding bringing in excessive noises in a modification process, effectively reducing an error existing between a high frequency band signal obtained by modification and an actual high frequency band signal, and increasing an accuracy rate of the predicted high frequency band signal.

The encoding device in the foregoing embodiment shown in FIG. 10 and the decoding device in the foregoing embodiment shown in FIG. 11 are merely optional embodiment structures of the present disclosure. In an actual application, more optional embodiment structures of the present disclosure may further be deduced according to the technical solutions of the foregoing embodiments shown in FIG. 3 to FIG. 9. For details, refer to the records in the foregoing embodiments. Details are not described herein again.

Figure 12:
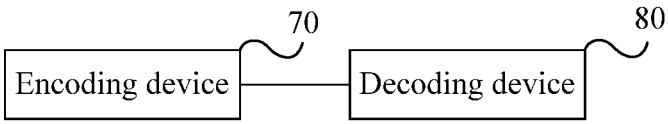
FIG. 12 is a schematic structural diagram of a system for predicting a high frequency band signal according to an embodiment of the present disclosure.

FIG. 12 is a schematic structural diagram of a system for predicting a high frequency band signal according to an embodiment of the present disclosure. In this embodiment, the system for predicting a high frequency band signal includes an encoding device 70 and a decoding device 80.

In this embodiment, the decoding device 80 may be the decoding device in the foregoing embodiment shown in FIG. 6 or FIG. 7. The encoding device 70 may be the encoding device in the other approaches or the encoding device in the foregoing embodiment shown in FIG. 8 or FIG. 9.

In the system for predicting a high frequency band signal in this embodiment, for details of a specific implementation process of predicting a high frequency band signal using the encoding device 70 and the decoding device 80, refer to the records in the foregoing embodiment shown in FIG. 6, FIG. 7, FIG. 8, or FIG. 9 and related method embodiments, and details are not described herein again.

According to the system for predicting a high frequency band signal in this embodiment, using the foregoing technical solution, for a harmonic signal and a non-harmonic signal, different envelope information is used to predict an excitation signal of a high frequency band signal, thereby avoiding bringing in excessive noises in a modification process, effectively reducing an error existing between a high frequency band signal obtained by modification and an actual high frequency band signal, and increasing an accuracy rate of the predicted high frequency band signal. In addition, when the decoding device in the embodiment shown in FIG. 7 is used in the system for predicting a high frequency band signal, continuity of excitation signals that are of high frequency band signals and are predicted in a former frame and a latter frame can further be effectively ensured, thereby ensuring auditory quality of a restored high frequency band signal and enhancing auditory quality of an audio signal.

Figure 13:
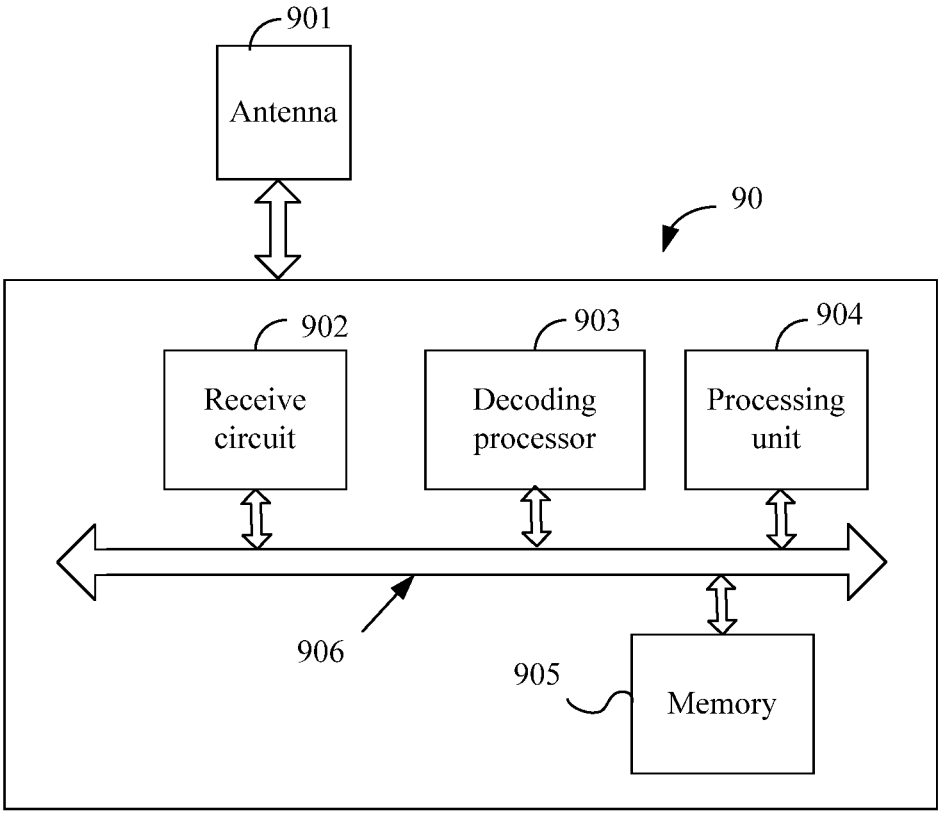
FIG. 13 is another example diagram of a decoding device according to an embodiment of the present disclosure.

FIG. 13 is a block diagram of an apparatus 90 according to another embodiment of the present disclosure. The apparatus 90 in FIG. 13 may be used to implement steps and methods in the foregoing method embodiments. The apparatus 90 may be applied to a base station or a terminal in various communications systems. In the embodiment of FIG. 13, the apparatus 90 includes a receive circuit 902, a decoding processor 903, a processing unit 904, a memory 905, and an antenna 901. The processing unit 904 controls an operation of the apparatus 90, and the processing unit 904 may also be referred to as a Central Processing Unit (CPU). The memory 905 may include a ROM and a RAM, and provides an instruction and data for the processing unit 904.

A part of the memory 905 may further include a nonvolatile RAM (NVRAM). In a specific application, a wireless communications device such as a mobile phone may be built in the apparatus 90, or the apparatus 90 may be a wireless communications device, and the apparatus 90 may further include a carrier that accommodates the receive circuit 902 in order to allow the apparatus 90 to receive data from a remote location. The receive circuit 902 may be coupled to the antenna 901. All components of the apparatus 90 are coupled together using a bus system 906, where in addition to a data bus, the bus system 906 further includes a power bus, a control bus, and a status signal bus. However, for clarity of description, various buses are marked as the bus system 906 in FIG. 13. The apparatus 90 may further include the processing unit 904 configured to process a signal, and in addition, further includes the decoding processor 903.

The methods disclosed in the foregoing embodiments of the present disclosure may be applied to the decoding processor 903, or implemented by the decoding processor 903. The decoding processor 903 may be an integrated circuit chip and has a signal processing capability. In an implementation process, steps in the foregoing method embodiments (for example, the method embodiment corresponding to FIG. 3) may be completed using an integrated logic circuit of hardware in the decoding processor 903 or instructions in a form of software. These instructions may be implemented and controlled by cooperating with the processing unit 904. The foregoing decoding processor may be a general purpose processor, a DSP, an application-specific integrated circuit (ASIC), a field programmable gate array (FPGA) or another programmable logic component, a discrete gate or a transistor logic component, or a discrete hardware component. The methods, the steps, and the logical block diagrams disclosed in the embodiments of the present disclosure may be implemented or performed. The general purpose processor may be a microprocessor, or the processor may be any conventional processor, translator, or the like. Steps of the methods disclosed with reference to the embodiments of the present disclosure may be directly executed and completed by the decoding processor embodied as hardware, or may be executed and completed using a combination of hardware and software modules in the decoding processor. The software module may be located in a mature storage medium in the art, such as a RAM, a flash memory, a ROM, a programmable ROM (PROM), an electrically erasable PROM (EEPROM), or a register. The storage medium is located in the memory 905. The decoding processor 903 reads information from the memory 905, and completes the steps of the foregoing methods in combination with the hardware.

For example, the signal decoding device in FIG. 6 or FIG. 7 may be implemented by the decoding processor 903. In addition, in FIG. 6, the first acquiring module 30, the second acquiring module 31, the predicting module 32, and the restoring module 33 may be implemented by the processing unit 904, or may be implemented by the decoding processor 903. Similarly, each module in FIG. 7 may be implemented by the processing unit 904, may be implemented by the decoding processor 903. However, the foregoing examples are merely exemplary, and are not intended to limit the embodiments of the present disclosure to this specific implementation manner.

Further, the memory 905 stores instructions which enables the processing unit 904 or the decoding processor 903 to implement the following operations acquiring a signal type of an audio signal and a low frequency band signal of the audio signal, where the audio signal includes the low frequency band signal and a high frequency band signal, acquiring a frequency envelope of the high frequency band signal according to the signal type, predicting an excitation signal of the high frequency band signal according to the low frequency band signal, and restoring the high frequency band signal according to the frequency envelope of the high frequency band signal and the excitation signal of the high frequency band signal.

Figure 14:
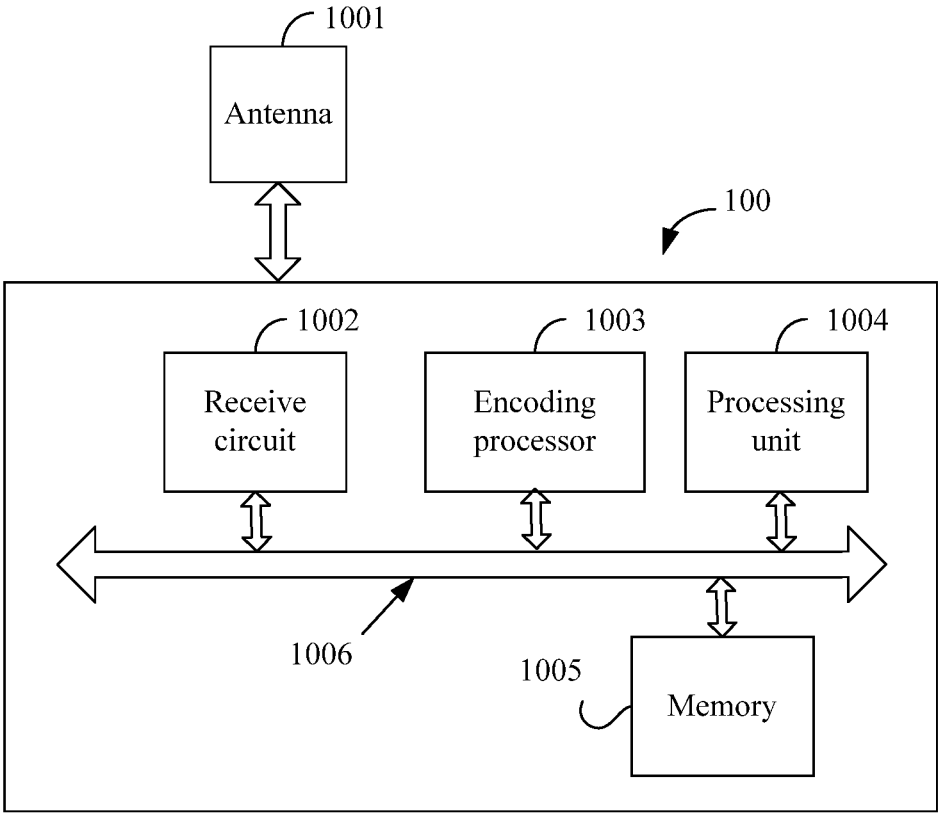
FIG. 14 is another example diagram of an encoding device according to an embodiment of the present disclosure.

FIG. 14 is a block diagram of an apparatus 100 according to another embodiment of the present disclosure. The apparatus 100 in FIG. 14 may be used to implement steps and methods in the foregoing method embodiments. The apparatus 100 may be applied to a base station or a terminal in various communications systems. In the embodiment of FIG. 14, the apparatus 100 includes a receive circuit 1002, an encoding processor 1003, a processing unit 1004, a memory 1005, and an antenna 1001. The processing unit 1004 controls an operation of the apparatus 100, and the processing unit 1004 may also be referred to as a CPU. The memory 1005 may include a ROM and a RAM, and provides an instruction and data for the processing unit 1004. A part of the memory 1005 may further include an NVRAM. In a specific application, a wireless communications device such as a mobile phone may be built in the apparatus 100, or the apparatus 100 may be a wireless communications device, and the apparatus 100 may further include a carrier that accommodates the receive circuit 1002 in order to allow the apparatus 100 to receive data from a remote location. The receive circuit 1002 may be coupled to the antenna 1001. All components of the apparatus 100 are coupled together using a bus system 1006, where in addition to a data bus, the bus system 1006 further includes a power bus, a control bus, and a status signal bus. However, for clarity of description, various buses are marked as the bus system 1006 in FIG. 14. The apparatus 100 may further include the processing unit 1004 configured to process a signal, and in addition, further includes the encoding processor 1003.

The methods disclosed in the foregoing embodiments of the present disclosure may be applied to the encoding processor 1003, or implemented by the encoding processor 1003. The encoding processor 1003 may be an integrated circuit chip and has a signal processing capability. In an implementation process, steps in the foregoing method embodiments (for example, the method embodiment corresponding to FIG. 4 or FIG. 5) may be completed using an integrated logic circuit of hardware in the encoding processor 1003 or instructions in a form of software. These instructions may be implemented and controlled by cooperating with the processing unit 1004. The foregoing encoding processor may be a general purpose processor, a DSP, an ASIC, an FPGA or another programmable logic component, a discrete gate or a transistor logic component, or a discrete hardware component. The methods, the steps, and the logical block diagrams disclosed in the embodiments of the present disclosure may be implemented or performed. The general purpose processor may be a microprocessor, or the processor may also be any conventional processor, translator, or the like. Steps of the methods disclosed with reference to the embodiments of the present disclosure may be directly executed and completed by a decoding processor embodied as hardware, or may be executed and completed using a combination of hardware and software modules in the decoding processor. The software module may be located in a mature storage medium in the art, such as a RAM, a flash memory, a ROM, a PROM, an EEPROM, or a register. The storage medium is located in the memory 1005. The encoding processor 1003 reads information from the memory 1005, and completes the steps of the foregoing methods in combination with the hardware.

For example, the signal encoding device in FIG. 8 or FIG. 9 may be implemented by the encoding processor 1003. In addition, in FIG. 8, the acquiring module 40, the encoding module 41, and the sending module 42 may be implemented by the processing unit 1004, or may be implemented by the encoding processor 1003. Similarly, each module in FIG. 9 may be implemented by the processing unit 1004, or may be implemented by the encoding processor 1003. However, the foregoing examples are merely exemplary, and are not intended to limit the embodiments of the present disclosure to this specific implementation manner.

Further, storage of the memory 1005 enables the processing unit 1004 or the encoding processor 1003 to implement instructions for the following operations of acquiring a signal type of an audio signal and a low frequency band signal of the audio signal, where the audio signal includes the low frequency band signal and a high frequency band signal, encoding a frequency envelope of the high frequency band signal according to the signal type to obtain the frequency envelope of the high frequency band signal, and sending, to a decoding device, a bitstream that carries the signal type, and encoding indices of the low frequency band signal and the frequency envelope of the high frequency band signal.

Further, storage of the memory 1005 enables the processing unit 1004 or the encoding processor 1003 to implement instructions for the following operations of acquiring a signal type of an audio signal and a low frequency band signal of the audio signal, where the signal type is a harmonic signal or a non-harmonic signal, and the audio signal includes the low frequency band signal and a high frequency band signal, calculating a frequency envelope of the high frequency band signal, where a method for calculating a frequency envelope of a high frequency band signal of a harmonic signal is the same as that of a non-harmonic signal, and sending, to a decoding device, a bitstream that carries the signal type, and encoding indices of the low frequency band signal and the frequency envelope of the high frequency band signal.

The described apparatus embodiment is merely exemplary. The units described as separate parts may or may not be physically separate, and parts displayed as units may or may not be physical units, may be located in one position, or may be distributed on at least two network units. Some or all of the modules may be selected according to actual needs to achieve the objectives of the solutions of the embodiments. A person of ordinary skill in the art may understand and implement the embodiments of the present disclosure without creative efforts.

Finally, it should be noted that the foregoing embodiments are merely intended for describing the technical solutions of the present disclosure but not for limiting the present disclosure. Although the present disclosure is described in detail with reference to the foregoing embodiments, persons of ordinary skill in the art should understand that they may still make modifications to the technical solutions described in the foregoing embodiments or make equivalent replacements to some technical features thereof, without departing from the spirit and scope of the technical solutions of the embodiments of the present disclosure.

What is claimed is:

1. A method for decoding an audio signal, comprising:

parsing a received bitstream to obtain mode information of a high frequency band signal of a first frame and a first index of a low frequency hand signal of the first frame, wherein the mode information indicates a harmonic mode for obtaining a frequency envelope of the high frequency band signal of the first frame;

obtaining, according to the harmonic mode, the frequency envelope of the high frequency band signal of the first frame;

obtaining the low frequency band signal of the first frame based on the first index;

predicting an excitation signal of the high frequency band signal of the first frame based on the low frequency band signal of the first frame;

reconstructing the high frequency band signal of the first frame based on the frequency envelope of the high frequency band signal of the first frame and the excitation signal of the high frequency band signal of the first frame;

outputting an audio signal of the first frame obtained based on the low frequency band signal of the first frame and the reconstructed high frequency band signal of the first frame;

parsing the received bitstream to obtain mode information of a high frequency band signal of a second frame and a second index of a low frequency band signal of the second frame, wherein the mode information indicates a non-harmonic mode for obtaining a frequency envelope of the high frequency band signal of the second frame;

obtaining, according to the non-harmonic mode, the frequency envelope of the high frequency band signal of the second frame, wherein a manner of obtaining the frequency envelope of the high frequency band signal of the first frame is different from a manner of obtaining the frequency envelope of the high frequency band signal of the second frame, obtaining the low frequency band signal of the second frame based on the second index;

predicting an excitation signal of the high frequency band signal of the second frame based on the low frequency band signal of the second frame;

reconstructing the high frequency band signal of the second frame based on the frequency envelope of the high frequency band signal of the second frame and the excitation signal of the high frequency band signal of the second frame; and outputting an audio signal of the second frame obtained based on the low frequency band signal of the second frame and the reconstructed high frequency band signal of the second frame.

2. The method of claim 1, wherein obtaining the frequency envelope of the high frequency band signal of the first frame comprises:

obtaining an initial frequency envelope of the high frequency band signal of the first frame, the initial frequency envelope of the high frequency band signal comprising a plurality of initial frequency envelopes corresponding to a plurality of subbands of the high frequency band signal of the first frame;

performing, for each subband of the high frequency band signal of the first frame, a weighting calculation on an initial frequency envelope of a subband and N initial frequency envelopes of N adjacent subbands to obtain a frequency envelope of the subband, wherein the N is greater than or equal to one; and combining the frequency envelopes of the subbands to obtain the frequency envelope of the high frequency band signal of the first frame.

3. The method of claim 1, wherein predicting the excitation signal of the high frequency band signal of the first frame based on the low frequency band signal of the first frame comprises:

determining whether a highest frequency bin of the low frequency band signal of the first frame is lower than a preset start frequency bin for bandwidth extension; and predicting the excitation signal of the high frequency hand signal of the first frame based on an excitation signal falling within a predetermined frequency band range and in the low frequency band signal of the first frame, wherein the preset start frequency bin for the bandwidth extension when the highest frequency bin of the low frequency band signal of the first frame is lower than the preset start frequency bin for the bandwidth extension.

4. The method of claim 3, wherein predicting the excitation signal of the high frequency band signal of the first frame comprises copying the excitation signal falling within the predetermined frequency band range of the first frame into a frequency band of the high frequency band signal consecutively until a frequency range between the preset start frequency bin for the bandwidth extension and a highest frequency bin of the frequency hand of the high frequency band signal of the first frame is filled.

5. The method of claim 1, wherein predicting the excitation signal of the high frequency band signal of the first frame based on the low frequency band signal of the first frame comprises:

determining whether a highest frequency bin of the low frequency band signal of the first frame is lower than a preset start frequency bin for bandwidth extension; and predicting the excitation signal of the high frequency band signal of the first frame based on an excitation signal falling within a predetermined frequency band range and in the low frequency band signal of the first frame, the preset start frequency bin for the bandwidth extension, and the highest frequency bin of the low frequency band signal of the first frame when the highest frequency bin of the low frequency band signal of the first frame is higher than or equal to the preset start frequency bin for the bandwidth extension.

6. The method of claim 5, wherein predicting the excitation signal of the high frequency band signal of the first frame comprises:

copying an excitation signal from an $m^{th}$ frequency bin above a start frequency bin ($f_{exc_start}$) of the predetermined frequency band range to an end frequency bin ($f_{exc_end}$) of the predetermined frequency band range;

making n copies of the excitation signal within the predetermined frequency band range; and setting the copied excitation signal from the $m^{th}$ frequency bin above the $f_{exc_start}$ of the predetermined frequency hand range to the $f_{exc_end}$ of the predetermined frequency band range and the n copies of the excitation signal within the predetermined frequency band range as an excitation signal between the highest frequency bin of the low frequency band signal of the first frame and a highest frequency bin of the high frequency band signal of the first frame, wherein the n comprises zero, a positive integer, or a positive decimal, and wherein the m comprises a quantity of frequency bins between the highest frequency bin of the low frequency band signal and the preset start frequency bin for the bandwidth extension.

7. A method for encoding an audio signal, comprising:

determining mode information of a high frequency band signal of a first frame, wherein the mode information indicates a harmonic mode for calculating a frequency envelope of the high frequency band signal of the first frame;

obtaining an index of a low frequency band signal of the first frame;

calculating, based on the harmonic mode, a frequency envelope of the high frequency band signal of the first frame;

obtaining an index of the frequency envelope of the high frequency hand signal of the first frame;

writing the mode information of the high frequency band signal of the first frame, the index of the low frequency band signal of the first frame, and the index of the frequency envelope of the high frequency band signal of the first frame into a bitstream for sending or storing;

determining mode information of a high frequency band signal of a second frame, the mode information indicates a non-harmonic mode for calculating a frequency envelope of the high frequency band signal of the second frame;

obtaining an index of a low frequency band signal of the second frame;

calculating, based on the non-harmonic mode, a frequency envelope of the high frequency band signal of the second frame, wherein a quantity of spectrum coefficients used for calculating the frequency envelope of the high frequency band signal of the first frame is different from a quantity of spectrum coefficients used for calculating the frequency envelope of the high frequency band signal of the second frame;

obtaining an index of the frequency envelope of the high frequency band signal of the second frame; and writing the mode information of the high frequency band signal of the second frame, the index of the low frequency band signal of the second frame, and the index of the frequency envelope of the high frequency band signal of the second frame into a bitstream for sending or storing.

8. The method of claim 7, wherein the quantity of spectrum coefficients used for calculating the frequency envelope of the high frequency band signal of the first frame is greater than the quantity of spectrum coefficients used for calculating the frequency envelope of the high frequency band signal of the second frame.

9. The method of claim 7, wherein the index of the low frequency band signal of the first frame of the audio signal is obtained based on the mode information.

10. The method of claim 9, wherein a bandwidth for obtaining the index of the low frequency band signal of the first frame is different from a bandwidth for obtaining the low frequency band signal of the second frame.

11. An audio signal decoder, comprising:

a memory storing instructions; and a processor coupled to the memory, wherein the instructions cause the processor to be configured to:

parse a received bitstream to obtain mode information of a high frequency band signal of a current frame of an audio signal and an index of a low frequency band signal of the current frame, wherein the mode information indicates a decoding mode for obtaining a frequency envelope of the high frequency band signal of the current frame, and wherein the decoding mode comprises either a harmonic mode or a non-harmonic mode;

obtain the frequency envelope of the high frequency band signal of the current frame based on the mode information, wherein a manner for obtaining the frequency envelope of the high frequency band signal of the current frame when the decoding mode is the harmonic mode that is different from a manner for obtaining the frequency envelope of the high frequency band signal of the current frame when the decoding mode is the non-harmonic mode;

obtain the low frequency band signal of the current frame based on the index of the low frequency band signal;

predict an excitation signal of the high frequency band signal based on the low frequency band signal;

reconstruct the high frequency band signal based on the frequency envelope of the high frequency band signal and the excitation signal of the high frequency band signal; and output an audio signal of the current frame obtained based on the low frequency band signal and the high frequency band signal to an application.

12. The audio signal decoder of claim 11, wherein when the decoding mode comprises the harmonic mode, in the manner of obtaining the frequency envelope of the high frequency band signal of the current frame based on the mode information, the instructions further cause the processor to be configured to:

obtain an initial frequency envelope of the high frequency band signal of the current frame, wherein the initial frequency envelope of the high frequency band signal comprises a plurality of initial frequency envelopes corresponding to a plurality of subbands of the high frequency band signal of the current frame;

perform, for each subband of the high frequency band signal of the current frame, a weighting calculation on an initial frequency envelope of a subband and N initial frequency envelopes of N adjacent subbands to obtain a frequency envelope of the subband, wherein the N is greater than or equal to one; and combine the frequency envelopes of the subbands to obtain the frequency envelope of the high frequency band signal of the current frame.

13. The audio signal decoder of claim 11, wherein in a manner of predicting the excitation signal of the high frequency band signal based on the low frequency band signal, the instructions further cause the processor to be configured to:

determine whether a highest frequency bin of the low frequency band signal is lower than a preset start frequency bin for bandwidth extension; and predict the excitation signal of the high frequency band signal based on an excitation signal falling within a predetermined frequency band range and in the low frequency band signal, wherein the preset start frequency bin for the bandwidth extension when the highest frequency bin of the low frequency band signal is lower than the preset start frequency bin for the bandwidth extension.

14. The audio signal decoder of claim 13, wherein in the manner of predicting the excitation signal of the high frequency hand signal, the instructions further cause the processor to be configured to copy the excitation signal falling within the predetermined frequency band range into a frequency band of the high frequency band signal consecutively until a frequency range between the preset start frequency bin for the bandwidth extension and a highest frequency bin of the frequency band of the high frequency band signal is filled.

15. The audio signal decoder of claim 11, wherein in a manner of predicting the excitation signal of the high frequency band signal based on the low frequency band signal, the instructions further cause the processor to be configured to:

determine whether a highest frequency bin of the low frequency band signal is lower than a preset start frequency bin for bandwidth extension; and predict the excitation signal of the high frequency band signal based on an excitation signal falling within a predetermined frequency hand range and in the low frequency band signal, the preset start frequency bin for the bandwidth extension, and the highest frequency bin of the low frequency band signal when the highest frequency bin of the low frequency band signal is higher than or equal to the preset start frequency bin for the bandwidth extension.

16. The audio signal decoder of claim 15, wherein in a manner of predicting the excitation signal of the high frequency band signal, the instructions further cause the processor to be configured to:

copy an excitation signal from an $m^{th}$ frequency bin above a start frequency bin ($f_{exc_start}$) of the predetermined frequency band range to an end frequency bin ($f_{exc_end}$) of the predetermined frequency band range;

make n copies of the excitation signal within the predetermined frequency band range; and set the copied excitation signal from the $m^{th}$ frequency bin above the $f_{exc_start}$ of the predetermined frequency band range to the $f_{exc_end}$ of the predetermined frequency band range and the n copies of the excitation signal within the predetermined frequency band range as an excitation signal between the highest frequency bin of the low frequency band signal and a highest frequency bin of the high frequency band signal, wherein the n comprises zero, a positive integer, or a positive decimal, and wherein the m comprises a quantity of frequency bins between the highest frequency bin of the low frequency band signal and the preset start frequency bin for the bandwidth extension.

17. An audio signal encoder, comprising:

a memory storing instructions; and a processor coupled to the memory, wherein the instructions cause the processor to be configured to:

determine mode information of a high frequency band signal of a current frame of an audio signal, wherein the mode information indicates an encoding mode for calculating a frequency envelope of the high frequency band signal of the current frame, and wherein the encoding mode comprises either a harmonic mode or a non-harmonic mode;

obtain an index of a low frequency band signal of the current frame;

calculate, based on the mode information, a frequency envelope of the high frequency band signal of the current frame, a quantity of spectrum coefficients used for calculating the frequency envelope of the high frequency band signal when the encoding mode is the harmonic mode that is different from a quantity of spectrum coefficients used for calculating the frequency envelope of the high frequency hand signal when the encoding mode is the non-harmonic mode;

obtain an index of the frequency envelope of the high frequency band signal; and write the mode information, the index of the low frequency band signal, and the index of the frequency envelope of the high frequency band signal into a bitstream for sending or storing.

18. The audio signal encoder of claim 17, wherein the quantity of spectrum coefficients used for calculating the frequency envelope of the high frequency band signal when the encoding mode comprises the harmonic mode is greater than the quantity of spectrum coefficients used for calculating the frequency envelope of the high frequency hand signal when the encoding mode comprises the non-harmonic mode.

19. The audio signal encoder of claim 17, wherein the index of the low frequency hand signal of the current frame of the audio signal is obtained based on the mode information.

20. The audio signal encoder of claim 19, wherein a bandwidth for obtaining the index of the low frequency band signal when the encoding mode comprises the harmonic mode is different from a bandwidth for obtaining the low frequency band signal when the encoding mode comprises the non-harmonic mode.

* * * * *